US006980763B2

(12) United States Patent
Murai et al.

(10) Patent No.: US 6,980,763 B2
(45) Date of Patent: Dec. 27, 2005

(54) IMAGE FIXING AND SMOOTHING PROCESS, BELT FIXING AND SMOOTHING APPARATUS AND ELECTROPHOTOGRAPHIC PRINT

(75) Inventors: Ashita Murai, Shizuoka (JP); Yoshio Kanesawa, Kanagawa (JP)

(73) Assignees: Fuji Photo Film Co., Ltd., Kanagawa (JP); Fuji Xerox Co., Ltd., Tokyo (JP)

( * ) Notice: Subject to any disclaimer, the term of this patent is extended or adjusted under 35 U.S.C. 154(b) by 75 days.

(21) Appl. No.: 10/693,927

(22) Filed: Oct. 28, 2003

(65) Prior Publication Data

US 2004/0086307 A1 May 6, 2004

(30) Foreign Application Priority Data

Oct. 29, 2002 (JP) ..... 2002-314995

(51) Int. Cl.[7] ..... G03G 15/20
(52) U.S. Cl. ..... 399/329; 399/341
(58) Field of Search ..... 399/302, 308, 399/329, 341; 219/216

(56) References Cited

U.S. PATENT DOCUMENTS 5,250,998 A * 10/1993 Ueda et al. ..... 399/329
5,933,694 A * 8/1999 Yamashita et al. ..... 399/322
2004/0076456 A1 * 4/2004 Tani et al. ..... 399/329
2004/0146325 A1 * 7/2004 Tani et al. ..... 399/329

FOREIGN PATENT DOCUMENTS

JP 2002-91048 A 3/2002
WO WO 91/03771 A 3/1991

* cited by examiner

*Primary Examiner*—Quana Grainger
(74) *Attorney, Agent, or Firm*—Sughrue Mion, PLLC

(57) ABSTRACT

To produce an electrophotographic print with high image quality and good texture and with minimized curling, a method produces an electrophotographic print by fixing a toner image on an image bearing surface of an electrophotographic image-receiving sheet using a belt fixing and smoothing apparatus including a hot-pressing device, a belt member, a cooling device, and a cooling-releasing section, smoothing the toner image, and releasing the sheet, in which an amount of curling C (mm) of the electrophotographic print is controlled to be more than −0.10 L and less than +0.05 L, wherein L is a length (mm) of a short side of the electrophotographic print; a negative value (−) of the amount of curling C means that the electrophotographic print curls toward its back side not bearing the image; and a positive value (+) of the amount of curling C means that the electrophotographic print curls toward its image-bearing surface.

21 Claims, 6 Drawing Sheets

SHORT SIDE OF L SIZE (89 mm)

SHORT SIDE OF A6 SIZE (105 mm)

IMAGE FIXING AND SMOOTHING PROCESS, BELT FIXING AND SMOOTHING APPARATUS AND ELECTROPHOTOGRAPHIC PRINT

BACKGROUND OF THE INVENTION

1. Field of the Invention

The present invention relates to an electrophotographic image forming process and image forming apparatus that can produce a high-quality electrophotographic print which has high gloss, less unevenness in image and high image quality close to silver halide photographic image quality, has texture equivalent to that of silver halide photographs and invites less curling and to such an electrophotographic print produced by the image forming process.

2. Description of the Related Art

Electrophotography is an image forming process in which a latent electrostatic image is formed on a photoconductor as a result of photoconduction and colored charged fine particles (a toner) are applied to the latent electrostatic image by action of electrostatic force to thereby form a visible image (toner image). Various attempts have been made to produce images with quality close or equivalent to that of silver halide photographs.

For example, Japanese Patent Application Publications (JP-B) No. 04-31389 and No. 04-31393 each disclose a method and an apparatus for improving image quality, in which a sheet is placed on a toner-image-bearing surface of a support bearing a fixed toner image, the resulting article is hot-pressed again to thereby fuse the toner image again, the fused toner image is cooled, and the support is removed from the sheet to thereby yield a toner image with appropriate gloss, high density, and optical transparency.

Japanese Patent Application Laid-Open (JP-A) No. 04-51156 proposes an image processing method in which a toner image is formed on a transparent image-receiving layer on a support, and the toner image is then embedded in the image-receiving layer.

JP-A No. 04-501925 proposes an image processing method in which an image-receiving paper (sheet) having a support, a thermoplastic resin layer on one side of the support, and an anti-curling layer arranged on the other side is used, and a toner image formed on the thermoplastic resin layer is brought into contact with a web, is heated and pressurized at a temperature equal to or higher than the glass transition point Tg of the thermoplastic resin, is cooled, and is removed from the web.

JP-A No. 08-211645 proposes an electrophotographic image-receiving sheet including a toner-image-receiving layer, a thermoplastic polymer layer, raw paper, a thermoplastic polymer layer, and an antistatic layer.

JP-A No. 2002-91048 discloses an electrophotographic image transfer sheet and a color image forming apparatus using the sheet. The examples thereof mention that a double-sided resin coated paper is cooled and released using a fixing belt.

However, the techniques disclosed in JP-B No. 04-31389, JP-B No. 04-31393, and JP-A No. 04-51156 do not use an electrophotographic image-receiving sheet including a support having a polyolefin resin layer at least on one side thereof, and the resulting print has insufficient smoothness and gloss and fails to have image quality close to silver halide photographic image quality.

The thermoplastic image-receiving layer directly arranged on a support disclosed in JP-A No. 04-501925 is affected by unevenness of the support, thereby has decreased surface smoothness and fails to yield image quality close to silver halide photographic image quality. In addition, the anti-curling layer does not effectively inhibit curling.

JP-A No. 08-211645 fails to teach a cooling and releasing process, and the resulting image has unevenness and fails to have gloss equivalent to silver halide photographs. In addition, this technique is not directed to inhibit curling.

JP-A No. 2002-91048 does not refer to inhibition of curling, and the technique disclosed therein cannot produce a print with high image quality close to silver halide photographic image quality with less curling.

SUMMARY OF THE INVENTION

Accordingly, an object of the present invention is to provide an electrophotographic image forming process and image forming apparatus that can produce a high-quality electrophotographic print having high gloss, less unevenness in image and high image quality close to silver halide photographic image quality, having texture equivalent to that of silver halide photographs and exhibiting less curling and to provide an electrophotographic print produced by the method.

After intensive investigations to achieve the above object, the present inventors have found that an image forming process should satisfy the following conditions. Specifically, in the method, (1) an electrophotographic image-receiving sheet containing a support having raw paper, a first polyolefin resin layer arranged between the toner-image-receiving layer and the support, and a second polyolefin resin layer arranged on an opposite side of the support to the first polyolefin resin layer, and at least one toner-image-receiving layer arranged on the support is used; (2) a toner image formed on an image bearing surface of the electrophotographic image-receiving sheet is fixed, is smoothed, and the sheet is released using a belt fixing and smoothing apparatus including a hot-pressing member, a belt member, a cooling device, and a cooling-releasing section; (3) the exit angle of the belt fixing and smoothing apparatus is set within an appropriate range; (4) the raw paper in the electrophotographic image-receiving sheet has a specific rigidity (basis weight); and (5) the first polyolefin resin layer in the electrophotographic image-receiving sheet has crystallinity lower than that of the second polyolefin resin layer as a result of specifying compositions of these layers. The present inventors have found that when the image forming process satisfies these conditions (1) to (5), the resulting electrophotographic print has high gloss, less unevenness in image and high image quality close to silver halide photographic image quality, has texture equivalent to that of silver halide photographs and invites less curling.

Specifically, the present invention provides an image forming process including the steps of fixing a toner image formed on an image bearing surface of an electrophotographic image-receiving sheet using a belt fixing and smoothing apparatus, smoothing the toner image, and releasing the electrophotographic image-receiving sheet bearing the toner image to thereby produce an electrophotographic print, the belt fixing and smoothing apparatus including a hot-pressing device, a belt member, a cooling device, and a cooling-releasing section, in which an amount of curling C (mm) of the electrophotographic print satisfies the following condition: $-0.10\ L \leqq C \leqq +0.05\ L$. The resulting electrophotographic print has high gloss, less unevenness in image and high image quality close to silver halide photographic image quality, has texture equivalent to that of silver halide photographs and invites less curling.

In the above condition, L is a length (mm) of a short side of the electrophotographic print; a negative value (−) of the amount of curling C means that the electrophotographic print curls so that its surface opposite to the image-bearing surface is inside; and a positive value (+) of the amount of curling C means that the electrophotographic print curls so that its image-bearing surface is inside.

The image forming apparatus of the present invention provides an image forming process including fixing means a toner image formed on an image bearing surface of an electrophotographic image-receiving sheet using a belt fixing and smoothing apparatus, smoothing the toner image, and releasing the electrophotographic image-receiving sheet bearing the toner image to thereby produce an electrophotographic print, the belt fixing and smoothing apparatus including a hot-pressing device, a belt member, a cooling device, and a cooling-releasing section, in which an amount of curling C (mm) of the electrophotographic print satisfies the following condition: $-0.10\,L \leqq C \leqq +0.05\,L$. The resulting electrophotographic print has high gloss, less unevenness in image and high image quality close to silver halide photographic image quality, has texture equivalent to that of silver halide photographs and invites less curling.

In the above condition, L is a length (mm) of a short side of the electrophotographic print; a negative value (−) of the amount of curling C means that the electrophotographic print curls so that its surface opposite to the image-bearing surface is inside; and a positive value (+) of the amount of curling C means that the electrophotographic print curls so that its image-bearing surface is inside.

The present invention further provides an electrophotographic print produced by the image forming process of the present invention. The resulting electrophotographic print has texture equivalent to that of silver halide photographs and curls in an appropriately minimized amount.

DESCRIPTION OF THE PREFERRED EMBODIMENTS (Image Forming Process and Image Forming Apparatus and Electrophotographic Print)

The image forming process and image forming apparatus of the present invention comprise the steps of fixing a toner image formed on an image bearing surface of an electrophotographic image-receiving sheet using a belt fixing and smoothing apparatus, smoothing the toner image, and releasing the electrophotographic image-receiving sheet bearing the fixed and smoothed toner image and thereby produces an electrophotographic print. The belt fixing and smoothing apparatus used herein includes a hot-pressing member, a belt member, a cooling device, and a cooling-releasing section.

The electrophotographic print of the present invention is produced by the image forming process of the present invention.

The image forming process of the present invention will be illustrated in detail below, together with the electrophotographic print of the present invention.

In the image forming process, the step of image-fixing and the step of smoothing can be performed in any order, but are preferably performed simultaneously or sequentially in this order.

The electrophotographic image-receiving sheet preferably comprises a support having raw paper and polyolefin resin layers arranged on both sides of the raw paper, and at least one toner-image-receiving layer arranged on the support for higher smoothness and gloss and better texture.

According to the present invention, the amount of curling of an electrophotographic print is specified, which electrophotographic print is produced by fixing and smoothing, a toner image formed on an image-bearing surface of the electrophotographic image-receiving sheet using the belt fixing and smoothing apparatus, and releasing the sheet.

Figure 1A:
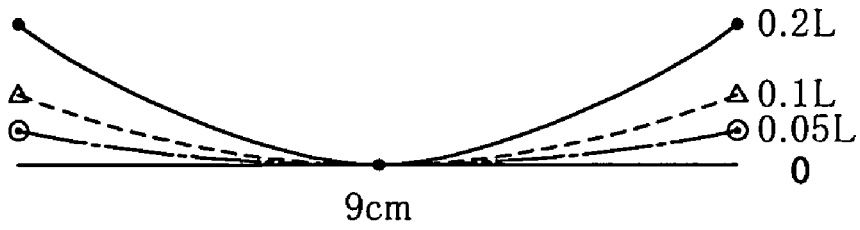
FIGS. 1A and 1B are schematic diagrams showing examples of the relationship between the length of a short side and the amount of curling in an electrophotographic print.
Figure 1B:
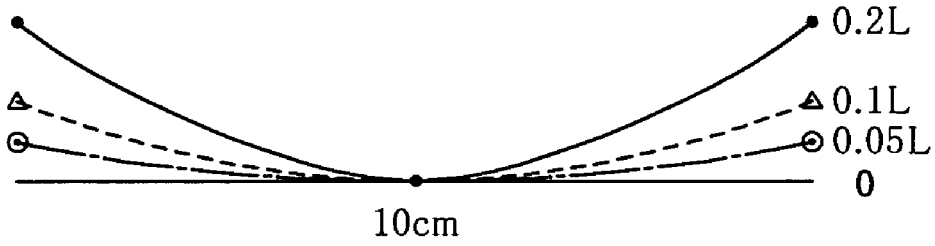

FIGS. 1A and 1B illustrate the relationship between the amount of curling and the short side length on a print 89 mm wide and 127 mm long (hereinafter this size is referred to as "L size") and an A6-size (105 mm wide and 150 mm long) print. As shown in FIGS. 1A and 1B, when the amount of curling C (mm) is a positive value and is 0.05 times or less the length L of the short side of the produced electrophotographic print, the curling of the print is acceptable, regardless of the length of the short side or long side of the electrophotographic print.

In FIGS. 1A and 1B, when the print curls upward, the amount of curling C is positive (hereinafter referred to "positive curling"), and when it curls downward, the amount of curling C is negative (hereinafter referred to as "negative curling"). The positive curling, i.e., the curling of the print toward its image-bearing surface (front side) is specifically undesirable, and the amount of curling C in the positive curling should be at most +0.05 L. An allowable level in the negative curling, i.e., the curling of an electrophotographic print toward its side opposite to the image-bearing surface (hereinafter briefly referred to as "back side"), is larger than that in the positive curling and its upper limit should be −0.10 L.

The amount of curling C (mm) of the electrophotographic print should be −0.10 L or more and +0.05 L or less, is preferably −0.05 L or more and +0.02 L or less, and is most preferably zero, i.e., the electrophotographic print is flat, wherein L, the negative value (−) and the positive value (+) of the amount of curling C have the same meanings as defined above.

The amount of curling C (mm) of an electrophotographic print can be determined in the following manner. The electrophotographic print is placed on a level surface of a stage so that a curled convex surface of the electrophotographic print points downward. The heights at four corners (four points) of the print are determined, and the amount of curling C (mm) is defined as the average of the measured four heights. When the curled convex surface is an image-bearing surface of the electrophotographic print, the amount of curling C is defined as positive (+), and when the curled convex is the back side of the electrophotographic print, the amount of curling C is defined as negative (−).

The amount of curling C (mm) is preferably determined after leaving the produced electrophotographic print at 25° C. and a relative humidity of 50% for 10 minutes. Preferably, the amount of curling C (mm) determined after leaving the electrophotographic print produced using the belt fixing and smoothing apparatus at 25° C. and a relative humidity of 50% for 10 minutes or longer (e.g., one year) satisfies the following condition:

$$-0.10\,L \leqq C \leqq +0.05\,L$$

wherein L, the negative value (−) and the positive value (+) of the amount of curling C have the same meanings as defined above. Thus, the electrophotographic print produced by the image forming process of the present invention shows a constant and minimized amount of curling C at 25° C. and a relative humidity of 50%. In other words, the image forming process can produce a high-quality photographic print that can keep its good smoothness and gloss over a long time.

The electrophotographic print preferably satisfies the above-specified requirement in the amount of curling at an amount of a toner on the image-bearing surface of the electrophotographic image-receiving sheet within a range from 0 g/m$^2$ (an entire white solid image, i.e., white background) to 12 g/m$^2$ (an entire black solid image). Thus, the resulting electrophotographic print is of high quality and exhibits an appropriately minimized amount of curling in all photographic images including images mainly comprising white areas such as an image of a snow scene, regular portrait images, landscape images, and images mainly comprising black areas such as an image of a night scene.

The angle (exit angle)θ between the tangent line in a nip between a heating roll and a pressure roll of the belt fixing and smoothing apparatus and the direction of travel of the belt member after passing through the nip preferably satisfies the following condition: $-2° < \theta \leqq 10°$.

Figure 2:
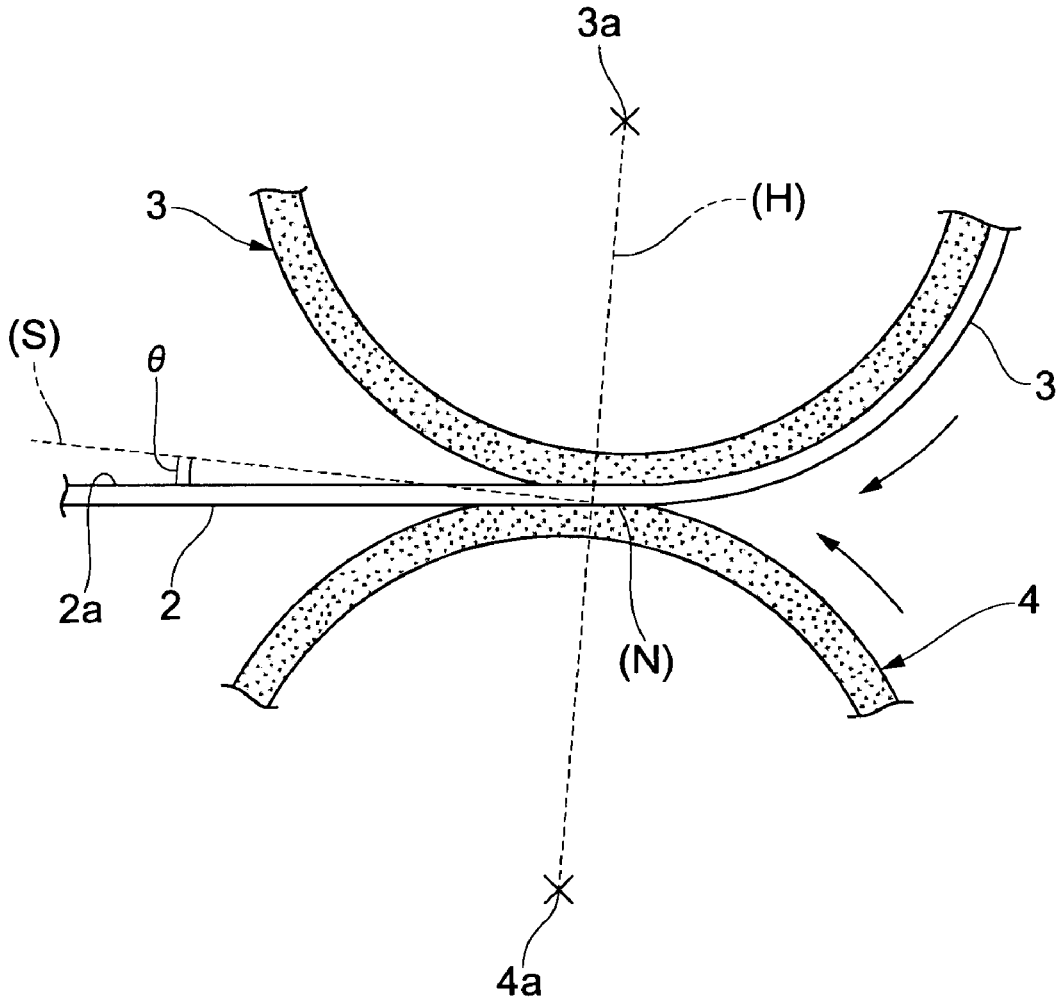
FIG. 2 is an enlarged view showing an exit angle in a nip in a belt fixing and smoothing apparatus.

More specifically, with reference to FIG. 2, the heating roll 3 and the pressure roll 4 in the belt fixing and smoothing apparatus are so arranged that the surface layer of the heating roll 3 and the surface layer of the pressure roll 4 are in intimate contact with each other in plane while both elastically deform to similar degrees. In this case, these components are so arranged that a perpendicular line (tangent line) S is positioned on the inner peripheral plane 2*a* side of the belt member 2, which perpendicular line S is orthogonal to a straight line H connecting between rotational centers 3*a* and 4*a* of the heating roll 3 and the pressure roll 4. The angle (exit angle) θ between the tangent line S in a nip N between the heating roll 3 and the pressure roll 4 and the travel direction of the belt member 2 after passing through the nip N is preferably more than −2° and less than 10°, and more preferably more than −1° and less than 5°.

If the exit angle θ exceeds 10°, the electrophotographic image-receiving sheet may drop off from the belt. If it is less than −2°, the resulting electrophotographic print may curl to an undesirable extent.

As is described above, the image forming process of the present invention fixes and smoothes a color toner, and releases the sheet bearing the color toner using the specific belt fixing and smoothing apparatus and the electrophotographic image-receiving sheet. The electrophotographic image-receiving sheet and the belt fixing and smoothing apparatus for use herein will be illustrated in more detail below.

<Electrophotographic Image-receiving Sheet>

The electrophotographic image-receiving sheet comprises a support having raw paper and polyolefin resin layers arranged on both sides of the raw paper, and at least one toner-image-receiving layer arranged on the support. It may further comprise at least one of additional layers appropriately selected according to necessity. Such additional layers include, for example, surface protective layers, interlayers, undercoat layers, cushioning layers, charge-control or antistatic layers, reflective layers, color-control layers, storage-stability improving layers, adhesion preventing layers, anti-curling layers, and smoothing layers.

Raw Paper

The raw paper is not specifically limited and can be appropriately selected according to the purpose. Preferred examples of the raw paper are woodfree paper such as paper described in "Basis of Photographic Technology—silver halide photography—" edited by The Society of Photographic Science and Technology of Japan, Corona Publishing Co., Ltd., p. 223–240 (1979).

Pulp fibers for use in the raw paper preferably have a fiber length distribution as described in JP-A No. 58-68037 for a desired center-line-average height (roughness) of its surface. For example, the total of mass percentages of 24-mesh on and that of 42-mesh on is preferably 20% by mass to 45% by mass. The content of 24-mesh on is preferably 5% by mass or less. The center-line-average height can be controlled by treating the surface of the raw paper with heat and pressure by machine calendering or super calendering.

Materials for the raw paper are not specifically limited and can be selected from those used in electrophotographic image-receiving sheets according to the purpose. Such materials include, for example, naturally occurring pulp of needle-leaved trees and of broadleaved trees, synthetic pulp made of synthetic resins such as polyethylenes and polypropylenes, and mixtures of naturally occurring pulp and synthetic pulp.

The pulp for use as the material for the raw paper is preferably latifoliate tree bleached kraft pulp (LBKP) for satisfactorily balanced surface smoothness, rigidity and dimensional stability (anti-curling properties) at sufficient level. Needle-leafs tree bleached kraft pulp (NBKP), latifoliate tree sulfite pulp, and other pulp can also be used as the pulp.

The pulp can be beaten with a beater or refiner.

The Canadian Standard Freeness (C.S.F.) of the pulp is preferably from 200 ml to 440 ml C.S.F., and more preferably from 250 ml to 380 ml C.S.F. for better control of shrinkage of paper in a paper making process.

A pulp slurry (hereinafter referred to as "pulp stock") obtained by beating the pulp may further comprise various additives. Such additives include, but are not limited to, fillers, agents for enhancing dry strength of paper, sizing agents, agents for enhancing wet strength of paper, bonding agents, pH adjusters, and other agents.

The fillers include, but are not limited to, calcium carbonate, clay, kaolin, China clay, talc, titanium dioxide, diatomaceous earth, barium sulfate, aluminum hydroxide, and magnesium hydroxide.

The agents for enhancing dry strength of paper include, but are not limited to, cationized starch, cationic polyacrylamides, anionic polyacrylamides, amphoteric polyacrylamides, and carboxy-modified poly(vinyl alcohol)s.

The sizing agents include, but are not limited to, fatty acid salts, rosin, maleic acid-added rosin, and other rosin derivatives, paraffin wax, alkyl ketene dimers, alkenyl succinic anhydrides (ASAs), and epoxidized fatty acid amides.

The agents for enhancing wet strength of paper include, but are not limited to, polyamine-polyamide-epichlorohydrin, melamine resins, urea resins, and epoxidized polyamide resins.

The bonding agents (fixing agents) include, but are not limited to, aluminum sulfate, aluminum chloride, and other polyvalent metallic salts; cationized starch and other cationic polymers.

The pH adjusters include, but are not limited to, sodium hydroxide, and sodium carbonate.

The other agents include, but are not limited to, antifoaming agents, dyes, slime control agents, and fluorescent brightening agents (fluorescent whitening agents).

The pulp stock may further comprise a softening agent. Examples of the softening agent can be found in, for example, New Paper Processing Handbook (Shigyo Taimususha Ltd., Japan) p. 554–555 (1980).

A composition for use in the surface sizing is not specifically limited, can be selected according to the purpose and may comprise, for example, a water-soluble polymer, a water-resistant substance, a pigment, a dye and/or a fluorescent brightening agent.

Such water-soluble polymers include, but are not limited to, cationized starch, poly(vinyl alcohol)s, carboxy-modified poly(vinyl alcohol)s, carboxymethylcellulose, hydroxyethylcellulose, cellulose sulfate, gelatin, casein, poly(sodium acrylate)s, sodium salt of styrene-maleic anhydride copolymers, and poly(sodium styrenesulfonate)s.

Examples of the water-resistant substance are latices and emulsions of, for example, styrene-butadiene copolymers, ethylene-vinyl acetate copolymers, polyethylenes, vinylidene chloride copolymers, and polyamide-polyamine-epichlorohydrin.

Examples of the pigment are calcium carbonate, clay, kaolin, talc, barium sulfate, and titanium dioxide.

To improve the rigidity (stiffness) and dimensional stability (anti-curling properties) of the electrophotographic image-receiving sheet, the raw paper preferably has the ratio (Ea/Eb) of a longitudinal Young's modulus Ea to a transverse Young's modulus Eb of from 1.5 to 2.0. If the ratio Ea/Eb is less than 1.5 or exceeds 2.0, the rigidity and anti-curling properties of the electrophotographic image-receiving sheet may apt to decrease, thus the resulting electrophotographic image-receiving sheet may not be carried or conveyed smoothly in a machine.

It has been found that in general, the "tone" of the paper differs based on differences in the way the paper is beaten, and the elasticity (modulus) of paper from paper-making after beating can be used as an important indication of the "tone" of the paper. The elastic modulus of the paper may be calculated from the following equation by using the relation of the dynamic modulus which shows the physical properties of a viscoelastic object and density, and measuring the velocity of sound propagation in the paper using an ultrasonic oscillator.

$$E=\rho c^2(1-n^2)$$

In equation, E is a dynamic modulus of elasticity ; ρ is a density; c is a sonic velocity in the paper; and n is a Poisson's ratio.

As n=0.2 in the case of ordinary paper, there is not much difference in the calculation if the calculation is performed by the following equation:

$$E=\rho c^2$$

That is, if the density of the paper and acoustic velocity can be measured, the elastic modulus can easily be calculated. In the above equation, when measuring acoustic velocity, various instruments known in the art may be used, such as a Sonic Tester SST-110 (Nomura Shoji Co., Ltd.).

The thickness of the raw paper is not specifically limited, can be appropriately set according to an intended purpose and is preferably from 30 μm to 500 μm, more preferably from 50 μm to 300 μm, and further preferably from 100 μm to 250 μm. The basis weight of the raw paper is not specifically limited, can be appropriately set according to an intended purpose and is, for example, preferably from 50 g/m$^2$ to 250 g/m$^2$, and more preferably from 100 g/m$^2$ to 200 g/m$^2$.

Polyolefin Resin Layer

The first polyolefin resin layer on the front side (side on which the toner-image-receiving layer is arranged) preferably has crystallinity lower than that of the second polyolefin resin layer on the back side (side on which the toner-image-receiving layer is not arranged) for appropriately minimized amount of curling. Namely, the first polyolefin resin layer on the front side of the support preferably comprises a low-density polyethylene, and the second polyolefin resin layer on the back side preferably comprises a high-density polyethylene or a mixture of a high-density polyethylene and a low-density polyethylene.

The polyolefins used herein may be, for example, a polypropylene, a high-density polyethylene (HDPE), a low-density polyethylene (LDPE), or a linear low-density polyethylene (LLDPE). Among them, a high-density polyethylene (HDPE) and a low-density polyethylene (LDPE) are preferred. Each of these resins can be used alone or in combination.

Generally, a low-density polyethylene is used as the polyolefin resin. However, for improving the thermal resistance of the support, it is preferred to use polypropylene, a blend of polypropylene and polyethylene, a high-density polyethylene, or a blend of the high-density polyethylene and a low-density polyethylene. From the viewpoint of cost and its suitableness for the lamination, it is preferred to use the blend of the high-density polyethylene and the low-density polyethylene.

The blend of the high-density polyethylene and the low-density polyethylene is used in a blend ratio (a mass ratio) of, for example, 1:9 to 9:1, preferably 2:8 to 8:2, and more preferably 3:7 to 7:3. The molecular weight of the polyethylenes is not particularly limited. Desirably, both of the high-density polyethylene and the low-density polyethylene have a melt index of 1.0 g/10-min. to 70 g/10-min. and a high extrudability.

The sheet or film to be laminated may be subjected to a treatment to impart white reflection thereto. For example, a pigment such as titanium dioxide is incorporated into the sheet or film.

The first (front-side) polyolefin resin layer and the second (backside) polyolefin resin layer each have a thickness of preferably 3 μm or more, and more preferably 5 μm or more.

The thickness of the support is preferably from 25 μm to 300 μm, more preferably from 50 μm to 260 μm, and further preferably from 75 μm to 220 μm. The support can have any rigidity according to the purpose.

Toner-image-receiving Layer

At least one toner-image-receiving layer is arranged on the support. The toner-image-receiving layer receives color or black toners to thereby form an image. The toner-image-receiving layer receives a toner for image formation from a development drum or an intermediate transfer member by action of (static) electricity or pressure in a transfer process and fixes the toner as an image by action of, for example, heat and/or pressure in an image-fixing process.

The toner-image-receiving layer mainly comprises at least one thermoplastic resin and may further comprise other components such as a releasing agent. The toner-image-receiving layer will be illustrated below in further detail.

Thermoplastic Resins

Thermoplastic resins for use in the present invention are not specifically limited as long as they can deform at temperatures during, for example, image-fixing and can receive the toner. They can be appropriately selected depending on an intended purpose and are preferably similar or the same resin as the binder resin of the toner. Polyester resins, styrene resins, styrene-butyl acrylate, and other copolymer resins are often used in most of such toners, and the image-receiving sheet preferably comprise any of these polyester resins, styrene resins, styrene-butyl acrylate, and other copolymer resins more preferably in an amount of 20% by mass or more. As the thermoplastic resins, styrene-acrylic ester copolymers and styrene-methacrylic ester copolymers are also preferred.

Examples of the thermoplastic resins are (i) resins each having an ester bond, (ii) polyurethane resins and similar resins, (iii) polyamide resins and similar resins, (iv) polysulfone resins and similar resins, (v) poly(vinyl chloride) resins and similar resins, (vi) poly(vinyl butyral) and similar resins, (vii) polycaprolactone resins and similar resins, and (viii) polyolefin resins and similar resins.

The resins (i) having an ester bond include, for example, polyester resins obtained by condensation of a dicarboxylic acid component with an alcohol component. Such dicarboxylic acid components include, but are not limited to, terephthalic acid, isophthalic acid, maleic acid, fumaric acid, phthalic acid, adipic acid, sebacic acid, azelaic acid, abietic acid, succinic acid, trimellitic acid, pyromellitic acid, and other dicarboxylic acids. Each of these dicarboxylic acid components may have a sulfonic acid group, a carboxyl group, or another group substituted thereon. The alcohol components include, but are not limited to, ethylene glycol, diethylene glycol, propylene glycol, bisphenol A, diether derivatives of bisphenol A (e.g., an ethylene oxide diadduct of bisphenol A, and a propylene oxide diadduct of bisphenol A), bisphenol S, 2-ethylcyclohexyldimethanol, neopentyl glycol, cyclohexyldimethanol, glycerol, and other alcohols. Each of these alcohol components may have a hydroxyl group or another group substituted thereon. The resins (i) also include poly(methyl methacrylate), poly(butyl methacrylate), poly(methyl acrylate), poly(butyl acrylate), and other polyacryic ester resins and polymethacrylic ester resins, polycarbonate resins, poly(vinyl acetate) resins, styrene-acrylate resins, styrene-methacrylate copolymer resins, and vinyltoluene-acrylate resins.

Typical disclosure of the resins (i) can be found in, for example, JP-A No. 59-101395, JP-A No. 63-7971, JP-A No. 63-7972, JP-A No. 63-7973, and JP-A No. 60-294862.

Such polyester resins are commercially available under the trade names of, for example, Vylon 290, Vylon 200, Vylon 280, Vylon 300, Vylon 103, Vylon GK-140, and Vylon GK-130 from Toyobo Co., Ltd.; Tuftone NE-382, Tuftone U-5, ATR-2009, and ATR-2010 from Kao Corporation; Elitel UE 3500, UE 3210, and XA-8153 from Unitika Ltd.; and Polyestar TP-220, and R-188 from Nippon Synthetic Chemical Industry Co., Ltd.

The acrylic resins are commercially available under the trade names of, for example, Dianal SE-5437, SE-5102, SE-5377, SE-5649, SE-5466, SE-5482, HR-169, HR-124, HR-1127, HR-116, HR-113, HR-148, HR-131, HR-470, HR-634, HR-606, HR-607, LR-1065, LR-574, LR-143, LR-396, LR-637, LR-162, LR-469, LR-216, BR-50, BR-52, BR-60, BR-64, BR-73, BR-75, BR-77, BR-79, BR-80, BR-83, BR-85, BR-87, BR-88, BR-90, BR-93, BR-95, BR-100, BR-101, BR-102, BR-105, BR-106, BR-107, BR-108, BR-112, BR-113, BR-115, BR-116, and BR-117 from Mitsubishi Rayon Co., Ltd.; S-LEC P SE-0020, SE-0040, SE-0070, SE-0100, SE-1010, and SE-1035 from Sekisui Chemical Co., Ltd.; Himer ST 95, and ST 120 from Sanyo Chemical Industries, Ltd.; and FM 601 from Mitsui Chemicals, Inc.

The poly(vinyl chloride) resins and similar resins (v) include, for example, poly(vinyl chloride) resins, poly(vinylidene chloride) resins, vinyl chloride-vinyl acetate copolymer resins, and vinyl chloride-vinyl propionate copolymer resins.

The poly(vinyl butyral) and similar resins (vi) include, for example, poly(vinyl butyral), polyol resins, as well as ethylcellulose resins, cellulose acetate resins, and other cellulosic resins. These resins are also commercially available from, for example, Denki Kagaku Kogyo Kabushiki Kaisha and Sekisui Chemical Co., Ltd. The poly(vinyl butyral) for use herein preferably comprises vinyl butyral in a content of 70% by mass or more and has an average polymerization degree of preferably 500 or more and more preferably 1000 or more. Such poly(vinyl butyral) is commercially available under the trade names of, for example, Denka Butyral 3000-1,4000-2, 5000 A, and 6000 C from Denki Kagaku Kogyo Kabushiki Kaisha; and S-LEC BL-1, BL-2, BL-3, BL-S, BX-L, BM-1, BM-2, BM-5, BM-S, BH-3, BX-1, and BX-7 from Sekisui Chemical Co., Ltd.

The polycaprolactone resins and similar resins (vii) further include, for example, styrene-maleic anhydride resins, polyacrylonitrile resins, polyether resins, epoxy resins, and phenol resins.

The polyolefin resins and similar resins (viii) include, for example, polyethylene resins, polypropylene resins, copolymer resins of an olefin such as ethylene or propylene with another vinyl monomer, and acrylic resins.

Each of these thermoplastic resins can be used alone or in combination. Mixtures of these thermoplastic resins and copolymers of monomers constituting the same can also be used.

The thermoplastic resin is preferably such a thermoplastic resin as to satisfy the requirements in the physical properties of a toner image receiving layer comprising the thermoplastic resin in question and is more preferably such a thermoplastic resin that can satisfy, by itself, the requirements. It is also preferred that two or more resins exhibiting different physical properties as the toner image receiving layer are used in combination.

The thermoplastic resin preferably has a molecular weight larger than that of a thermoplastic resin used in the toner. However, this relationship in molecular weight between two thermoplastic resins may not be applied to some cases. For example, when the thermoplastic resin used in the toner image receiving layer has a softening point higher than that of the thermoplastic resin used in the toner, the former thermoplastic resin may preferably have a molecular weight equivalent to or lower than that of the latter thermoplastic resin.

A mixture of resins having the same composition but different average molecular weights is also preferably used as the thermoplastic resin. The relationship in molecular weight between the thermoplastic resin used in the toner image receiving layer and that used in the toner is preferably one disclosed in JP-A No. 08-334915.

The thermoplastic resin preferably has a particle size distribution larger than that of the thermoplastic resin used in the toner.

The thermoplastic resin preferably satisfies the requirements in physical properties as disclosed in, for example, JP-A No. 05-127413, No. 08-194394, No. 08-334915, No. 08-334916, No. 09-171265, and No. 10-221877.

The thermoplastic resin for use in the toner-image-receiving layer is typically preferably at least one of water-soluble resins, water-dispersible resins, and other aqueous resins for the following reasons (i) and (ii).

(i) These aqueous resins do not invite exhaustion of an organic solvent in a coating and drying process and are thereby environment friendly and have good workability.

(ii) Most of waxes and other releasing agents cannot be significantly dissolved in solvents at room temperature and are often dispersed in a medium (water or an organic solvent) before use. Such aqueous dispersions are more stable and suitable in production processes. When an aqueous composition containing the thermoplastic resin and a wax is applied, the wax readily bleeds out on the surface of a coated layer, thus yielding the effects of the releasing agent (anti-offset properties and adhesion resistance) more satisfactorily.

The aqueous resins are not specifically limited in their compositions, bonding configurations, molecular structures, molecular weights, molecular weight distributions, shapes, and other factors and can be appropriately selected depending on an intended purpose, as long as they are water-soluble or water-dispersible resins. Examples of groups that impart hydrophilicity to polymers are sulfonic acid groups, hydroxyl groups, carboxyl groups, amino groups, amide groups, and ether groups.

Typical disclosure of the aqueous resins can be found in, for example, Research Disclosure No. 17,643, pp. 26; Research Disclosure No. 18,716, pp. 651; Research Disclosure No. 307,105, pp. 873–874; and JP-A No. 64-13546, pp. 71–75 (in Japanese).

Examples of such aqueous resins are vinylpyrrolidone-vinyl acetate copolymers, styrene-vinylpyrrolidone copolymers, styrene-maleic anhydride copolymers, water-soluble polyesters, water-soluble acrylics, water-soluble polyurethanes, water-soluble nylons (water-soluble polyamides), and water-soluble epoxy resins. Moreover, various types of gelatins may be selected according to the purpose from among liming gelatin, acid-treated gelatin and deliming gelatin wherein the content of calcium, etc., is reduced, and it is also preferable to use these in combination. Examples of water-soluble polyesters are various Pluscoats from Goo Chemical Co., Ltd. and the Finetex ES series from Dainippon Ink & Chemicals In. Examples of water-soluble acrylics are the Jurymer AT series from Nihon Junyaku Co., Ltd., Finetex 6161 and K-96 from Dainippon Ink & Chemicals Inc., and Hiros NL-1189 and BH-997L from Seiko Chemical Industries Co., Ltd.

Examples of water dispersible resins are water-dispersible type resins such as water-dispersible acrylate resin, water-dispersible polyester resin, water-dispersible polystyrene resin and water-dispersible urethane resin; and emulsions such as acrylate resin emulsion, polyvinyl acetate emulsion and SBR (styrene butadiene) emulsion. The resin can be conveniently selected from an aqueous dispersion of the aforesaid thermoplastic resins (i) to (viii), their emulsions, or their copolymers, mixtures and cation-modified derivatives, and two or more sorts can be combined.

Examples of the aforesaid water-dispersible resins in the polyester class are the Vylonal Series from Toyobo Co., Ltd, the Pesresin A Series from Takamatsu Oil & Fat Co., Ltd., the Tuftone UE Series from Kao Corporation, the WR Series from Nippon Synthetic Chemical Industry Co., Ltd., and the Elitel Series from Unitika Ltd., and in the acrylic class are the Hiros XE, KE and PE series from Seiko Chemical Industries Co., Ltd., and the Jurymer ET series from Nihon Junyaku Co., Ltd.

It is preferred that the film-forming temperature (MFT) of the polymer is above room temperature for storage before printing, and is less than 100° C. for fixing of toner particles.

The thermoplastic resin for use in the present invention is preferably a self-dispersible and water-dispersible polyester resin emulsion satisfying the following conditions (1) to (4). This type of polyester resin emulsion is self-dispersible requiring no surfactant, is low in moisture absorbency even in an atmosphere at high humidity, exhibits less decrease in its softening point due to moisture and can thereby avoid offset in image-fixing and failures due to adhesion between sheets during storage. The emulsion is water-based and is environmentally friendly and excellent in workability. In addition, the polyester resin used herein readily takes a molecular structure with high cohesive energy. Accordingly, the resin has sufficient hardness (rigidity) during its storage but is melted with low elasticity and low viscosity during an image-fixing process for electrophotography, and the toner is sufficiently embedded in the toner-image-receiving layer to thereby form images having sufficiently high quality.

(1) The number-average molecular weight Mn is preferably from 5000 to 10000 and more preferably from 5000 to 7000.

(2) The molecular weight distribution (Mw/Mn) is preferably 4 or less, and more preferably 3 or less, wherein Mw is the weight-average molecular weight.

(3) The glass transition temperature Tg is preferably from 40° C. to 100° C. and more preferably from 50° C. to 80° C.

(4) The volume average particle diameter is preferably from 20 nm to 200 nm and more preferably from 40 nm to 150 nm.

The content of the thermoplastic resin in the toner-image-receiving layer is preferably from 10% by mass to 90% by mass, more preferably from 30% by mass to 90% by mass.

The releasing agent is incorporated into the toner-image-receiving layer so as to prevent offset of the toner-image-receiving layer. The releasing agent is not specifically limited and can be appropriately selected, as long as it is melted or fused by heating at an image-fixing temperature, is deposited to thereby form a releasing agent layer on the surface of the toner-image-receiving layer by cooling and solidifying.

The releasing agent having such activities can be at least one of silicone compounds, fluorine compounds, waxes, and matting agents. Among them, at least one selected from silicone oils, polyethylene wax, carnauba wax, silicone particles, and polyethylene wax particles is preferably used.

As the releasing agents, the compounds mentioned for example in "Properties and Applications of Waxes", Revised Edition, published by Saiwai Shobo, or The Silicon Handbook published by THE NIKKAN KOGYO SHIMBUN, may be used. Further, the silicon compounds, fluorine compounds or waxes used for the toners mentioned in JP-B Nos. 59-38581, 04-32380, Japanese Patents Nos. 2838498, 2949558, JP-A Nos. 50-117433, 52-52640, 57-148755, 61-62056, 61-62057, 61-118760, 02-42451, 03-41465, 04-212175, 04-214570, 04-263267, 05-34966, 05-119514, 06-59502, 06-161150, 06-175396, 06-219040, 06-230600, 06-295093, 07-36210, 07-43940, 07-56387, 07-56390, 07-64335, 07-199681, 07-223362, 07-287413, 08-184992, 08-227180, 08-248671, 08-248799, 08-248801, 08-278663, 09-152739, 09-160278, 09-185181, 09-319139, 09-319143, 10-20549, 10-48889, 10-198069, 10-207116, 11-2917, 11-44969, 11-65156, 11-73049 and 11-194542 can also be used. Moreover, two or more sets of these compounds can be used.

Examples of silicone compounds are non-modified silicone oils (specifically, dimethyl siloxane oil, methyl hydrogen silicone oil, phenyl methyl-silicone oil, or products such as KF-96, KF-96L, KF-96H, KF-99, KF-50, KF-54, KF-56, KF-965, KF-968, KF-994, KF-995 and HIVAC F-4, F-5 from Shin-Etsu Chemical Co., Ltd.; SH200, SH203, SH490, SH510, SH550, SH710, SH704, SH705, SH7028A, SH7036, SM7060, SM7001, SM7706, SH7036, SH8710, SH1107 and SH8627 from Dow Corning Toray Silicone Co., Ltd.; and TSF400, TSF401, TSF404, TSF405, TSF431, TSF433, TSF434, TSF437, TSF450 Series, TSF451 series, TSF456, TSF458 Series, TSF483, TSF484, TSF4045, TSF4300, TSF4600, YF33 Series, YF-3057, YF-3800, YF-3802, YF-3804, YF-3807, YF-3897, XF-3905, XS69-A1753, TEX100, TEX101, TEX102, TEX103, TEX104, TSW831, from Toshiba Silicones), amino-modified silicone oils (e.g., KF-857, KF-858, KF-859, KF-861, KF-864 and KF-880 from Shin-Etsu Chemical Co., Ltd., SF8417 and SM8709 from Dow Corning Toray Silicone Co., Ltd., and TSF4700,TSF4701, TSF4702, TSF4703, TSF4704, TSF4705, TSF4706, TEX150, TEX151 and TEX154 from Toshiba Silicones), carboxy-modified silicone oils (e.g., BY16-880 from Dow Corning Toray Silicone Co., Ltd., TSF4770 and XF42-A9248 from Toshiba Silicones), carbinol-modified silicone oils (e.g., XF42-B0970 from Toshiba Silicones), vinyl-modified silicone oils (e.g., XF40-A1987 from Toshiba Silicones), epoxy-modified silicone oils (e.g., SF8411 and SF8413 from Dow Corning Toray Silicone Co., Ltd.; TSF3965, TSF4730, TSF4732, XF42-A4439, XF42-A4438, XF42-A5041, XC96-A4462, XC96-A4463, XC96-A4464 and TEX170 from Toshiba Silicones), polyether-modified silicone oils (e.g., KF-351 (A), KF-352 (A), KF-353 (A), KF-354 (A), KF-355 (A), KF-615(A), KF-618 and KF-945 (A) from Shin-Etsu Chemical Co., Ltd.; SH3746, SH3771, SF8421, SF8419, SH8400 and SF8410 from Dow Corning Toray Silicone Co., Ltd.; TSF4440, TSF4441, TSF4445, TSF4446, TSF4450, TSF4452, TSF4453 and TSF4460 from Toshiba Silicones), silanol-modified silicone oils, methacrylic-modified silicone oils, mercapto-modified silicone oils, alcohol-modified silicone oils (e.g., SF8427 and SF8428 from Dow Corning Toray Silicone Co., Ltd., TSF4750, TSF4751 and XF42-B0970 from Toshiba Silicones), alkyl-modified silicone oils (e.g., SF8416 from Dow Corning Toray Silicone Co., Ltd., TSF410, TSF411, TSF4420, TSF4421, TSF4422, TSF4450, XF42-334, XF42-A3160 and XF42-A3161 from Toshiba Silicones), fluorine-modified silicone oils (e.g., FS1265 from Dow Corning Toray Silicone Co., Ltd., and FQF501 from Toshiba Silicones), silicone rubbers and silicone particulates (e.g., SH851, SH745U, SH55UA, SE4705U, SH502 UA&B, SRX539U, SE6770 U-P, DY38-038, DY38-047, Trefil F-201, F-202, F-250, R-900, R-902A, E-500, E-600, E-601, E-506, BY29-119 from Dow Corning Toray Silicone Co., Ltd.; Tospal 105, 120, 130, 145, 240 and 3120 from Toshiba Silicones), silicone-modified resins (specifically, olefin resins or polyester resins, vinyl resins, polyamide resins, cellulosic resins, phenoxy resins, vinyl chloride-vinyl acetate resins, urethane resins, acrylate resins, styrene-acrylate resins and their copolymerization resins modified by silicone, e.g., DAIALLOMER SP203V, SP712, SP2105 and SP3023 from Dainichiseika Color & Chemicals MFG Co., Ltd.; Modiper FS700, FS710, FS720, FS730 and FS770 from NOF CORPORATION; Simac US-270, US-350, US-352, US-380, US-413, US-450, Reseda GP-705, GS-30, GF-150 and GF-300 from TOAGOSEI CO,. LTD.; SH997, SR2114, SH2104, SR2115, SR2202, DCI-2577, SR2317, SE4001U, SRX625B, SRX643, SRX439U, SRX488U, SH804, SH840, SR2107 and SR2115 from Dow Corning Toray Silicone Co., Ltd., YR3370, TSR1122, TSR102, TSR108, TSR116, TSR117, TSR125A, TSR127B, TSR144, TSR180, TSR187, YR47, YR3187, YR3224, YR3232, YR3270, YR3286, YR3340, YR3365, TEX152, TEX153, TEX171 and TEX172 from Toshiba Silicones), and reactive silicone compounds (specifically, addition reaction type, peroxide-curing type and ultraviolet radiation curing type, e.g., TSR1500, TSR1510, TSR1511, TSR1515, TSR1520, YR3286, YR3340, PSA6574, TPR6500, TPR6501, TPR6600, TPR6702, TPR6604, TPR6700, TPR6701, TPR6705, TPR6707, TPR6708, TPR6710, TPR6712, TPR6721, TPR6722, UV9300, UV9315, UV9425, UV9430, XS56-A2775, XS56-A2982, XS56-A3075, XS56-A3969, XS56-A5730, XS56-A8012, XS56-B1794, SL6100, SM3000, SM3030, SM3200 and YSR3022 from Toshiba Silicones).

Examples of fluorine compounds are fluorine oils (e.g., Daifluoryl #1, #3, #10, #20, #50, #100, Unidyne TG-440, TG-452, TG-490, TG-560, TG-561, TG-590, TG-652, TG-670U, TG-991, TG-999, TG-3010, TG-3020 and TG-3510 from Daikin Industries, Ltd.; MF-100, MF-110, MF-120, MF-130, MF-160 and MF-160E from Torchem Products; S-111, S-112, S-113, S-121, S-131, S-132, S-141 and S-145 from Asahi Glass Co., Ltd.; and, FC-430 and FC431 from DU PONT-MITSUI FLUOROCHEMICALS COMPANY, LTD), fluororubbers (e.g., LS63U from Dow Corning Toray Silicone Co., Ltd.), fluorine-modified resins (e.g., Modiper F220, F600, F2020, FF203, FF204 and F3035 from Nippon Oils and Fats; DAIALLOMER FF203 and FF204 from Dainichiseika Color & Chemicals MFG Co., Ltd.; Surflon S-381, S-383, S-393, SC-101, SC-105, KH-40 and SA-100 from Asahi Glass Co., Ltd.; E-351, EF-352, EF-801, EF-802, EF-601, TFEA, TFEMA and PDFOH from Torchem Products; and THV-200P from Sumitomo 3M), fluorine sulfonic acid compound (e.g., EF-101, EF-102, EF-103, EF-104, EF-105, EF-112, EF-121, EF-122A, EF-122B, EF-122C, EF-123A, EF-123B, EF-125M, EF-132, EF-135M, EF-305, FBSA, KFBS and LFBS from Torchem Products), fluorosulfonic acid, and fluorine acid compounds or salts (specifically, anhydrous hydrogen fluoride, dilute hydrofluoric acid, fluoroboric acid, zinc fluoroborate, nickel fluoroborate, tin fluoroborate, lead fluoroborate, copper fluoroborate, hydrofluorosilicic acid, fluorinated potassium titanate, perfluorocaprylic acid and ammonium perfluorooctanoate), inorganic fluorides (specifically, aluminum fluoride, potassium fluoride, fluorinated potassium zirconate, fluorinated zinc tetrahydrate, calcium fluoride, lithium fluoride, barium fluoride, tin fluoride, potassium fluoride, acid potassium fluoride, magnesium fluoride, fluorinated titanic acid, fluorinated zirconic acid, ammonium hexafluorinated phosphoric acid and potassium hexafluorinated phosphoric acid).

The waxes include, but are not limited to, synthetic hydrocarbons, modified waxes, hydrogenated waxes, and naturally occurring waxes.

Examples of synthetic hydrocarbons are polyethylene waxes (e.g., Polylon A, 393 and H-481 from Chukyo Yushi Co., Ltd., and Sanwax E-310, E-330, E-250P, LEL-250, LEL-800 and LEL-400P from Sanyo Chemical Industries, Ltd. ), polypropylene waxes (e.g., Biscol 330-P, 550-P and 660-P from Sanyo Chemical Industries, Ltd.), Fischer-Tropsch wax (e.g., FT100 and FT-0070 from Japan wax), and acid amide compounds or acid imide compounds (specifically, stearic acid amides and anhydrous phthalic imides such as Selosol 920, B-495, high micron G-270, G-110 and Hidorin D-757 from Chukyo Yushi Co., Ltd.).

Examples of modified waxes are amine-modified polypropylenes (e.g., QN-7700 from Sanyo Chemical Industries, Ltd.), acrylic acid-modified, fluorine-modified or olefin-modified waxes, urethane waxes (e.g., NPS-6010 and HAD-5090 from Japan Wax), and alcohol waxes (e.g., NPS-9210, NPS-9215, OX-1949 and XO-020T from Japan Wax).

Examples of hydrogenated waxes are castor oil (e.g., castor wax from Itoh Oil Chemicals Co., Ltd., castor oil derivatives (e.g., dehydrated castor oil DCO, DCO Z-1, DCO Z-3, castor oil fatty acid CO-FA, ricinoleic acid, dehydrated castor oil fatty acid DCO-FA, dehydrated castor oil fatty acid epoxy ester 4 ester, castor oil urethane acrylate CA-10, CA-20, CA-30, castor oil derivative MINERASOL S-74, S-80, S-203, S-42X, S-321, special castor oil condensation fatty acid MINERASOL RC-2, RC-17, RC-55, RC-335, special castor oil condensation fatty acid ester MINERASOL LB-601, LB-603, LB-604, LB-702, LB-703, #11 and L-164 from Itoh Oil Chemicals Co., Ltd.), stearic acid (e.g., 12-hydroxystearic acid from Itoh Oil Chemicals Co., Ltd.), lauric acid, myristic acid, palmitic acid, behenic acid, sebacic acid (e.g., sebacic acid from Itoh Oil Chemicals Co., Ltd.), undecylenic acid (e.g., undecylenic acid from Itoh Oil Chemicals Co., Ltd.), heptyl acids (heptyl acids from Itoh Oil Chemicals Co., Ltd.), maleic acid, high grade maleic oils (e.g., HIMALEIN DC-15, LN-10, 00-15, DF-20 and SF-20 from Itoh Oil Chemicals Co., Ltd.), blown oils (e.g., Selbonol #10, #30, #60, R-40 and S-7 from Itoh Oil Chemicals Co., Ltd.) and synthetic waxes such as cyclopentadienyl-group introduced oils (CP oil and CP oil-S from Itoh Oil Chemicals Co., Ltd.).

Preferred examples of the naturally occurring waxes are vegetable waxes, animal waxes, mineral waxes, and petroleum waxes.

Examples of vegetable waxes are carnauba waxes (e.g., EMUSTAR AR-0413 from Japan Wax, and Selosol 524 from Chukyo Yushi Co., Ltd.), castor oil (purified castor oil from Itoh Oil Chemicals Co., Ltd.), rape oil, soybean oil, Japan tallow, cotton wax, rice wax, sugarcane wax, candelilla wax, Japan wax and jojoba oil. Among them, carnauba waxes having a melting point of 70° C. to 95° C. are preferred, since the resulting image-receiving sheet has excellent anti-offset properties and adhesion resistance, can pass through a machine smoothly, has good glossiness, invites less cracking and can form high-quality images.

The animal waxes include, but are not limited to, lanolin, spermaceti waxes, whale oils, and wool waxes.

Examples of mineral waxes are natural waxes such as montan wax, montan ester wax, ozokerite and ceresin, or fatty acid esters (Sansocizer-DOA, AN-800, DINA, DIDA, DOZ, DOS, TOTM, TITM, E-PS, nE-PS, E-PO, E-4030, E-6000, E-2000H, E-9000H, TCP and C-1100, New Japan Chemical Co., Ltd.). Among them, montan waxes having a melting point of 70° C. to 95° C. are preferred, since the resulting image-receiving sheet has excellent anti-offset properties and adhesion resistance, can pass through a machine smoothly, has good glossiness, invites less cracking and can form high-quality images.

Preferred examples of petroleum waxes may for example be a paraffin wax (e.g., Paraffin wax 155, 150, 140, 135, 130, 125, 120, 115, HNP-3, HNP-5, HNP-9, HNP-10, HNP-11, HNP-12, HNP-14G, SP-0160, SP-0145, SP-1040, SP-1035, SP-3040, SP-3035, NPS-8070, NPS-L-70, OX-2151, OX-2251, EMUSTAR-0384 and EMUSTAR-0136 from Japan Wax; Selosol 686, 428, 651-A, A, H-803, B-460, E-172, 866, K-133, Hidorin D-337 and E-139 from Chukyo Yushi Co., Ltd.; 125 paraffin, 125° FD, 130° paraffin, 135° paraffin, 135° H, 140° paraffin, 140° N, 1450 paraffin and paraffin wax M from Nisseki Mitsubishi Petroleum), or a microcrystalline wax (e.g., Hi-Mic-2095, Hi-Mic-3090, Hi-Mic-1080, Hi-Mic-1070, Hi-Mic-2065, Hi-Mic-1045, Hi-Mic-2045, EMUSTAR-0001 and EMUSTAR-042X from Japan Wax; Selosol 967, M, from Chukyo Yushi Co., Ltd.; 55 Microwax and 180 Microwax from Nisseki Mitsubishi Petroleum), and petrolatum (e.g., OX-1749, OX-0450, OX-0650B, OX-0153, OX-261BN, OX-0851, OX-0550, OX-0750B, JP-1500, JP-056R and JP-011P from Japan Wax).

The content of the naturally occurring wax in the toner-image-receiving layer (surface layer) is preferably from 0.1 $g/m^2$ to 4 $g/m^2$, and more preferably from 0.2 $g/m^2$ to 2 $g/m^2$.

If the content is less than 0.1 $g/m^2$, sufficient anti-offset properties and adhesion resistance may not be obtained. If it exceeds 4 $g/m^2$, the resulting images may decreased quality due to excessive wax.

To obtain satisfactory anti-offset properties and to allow the sheet to pass through a machine smoothly, the melting point of the naturally occurring wax is preferably from 70° C. to 95° C., and more preferably from 75° C. to 90° C.

The matting agents include various conventional matting agents. Solid particles for use in the matting agents can be classified as inorganic particles and organic particles. Specifically, inorganic matting agents may be oxides (for example, silicon dioxide, titanium oxide, magnesium oxide, aluminum oxide), alkaline earth metal salts (for example, barium sulfate, calcium carbonate, magnesium sulfate), silver halides (for example, silver chloride or silver bromide), and glass.

Examples of inorganic matting agents are given for example in West German Patent No. 2529321, UK Patents Nos. 760775, 1260772, and U.S. Pat. Nos. 1,201,905, 2,192,241, 3,053,662, 3,062,649, 3,257,206, 3,322,555, 3,353,958, 3,370,951, 3,411,907, 3,437,484, 3,523,022, 3,615,554, 3,635,714, 3,769,020, 4,021,245 and 4,029,504.

The aforesaid organic matting agent contains starch, cellulose ester (for example, cellulose-acetate propionate), cellulose ether (for example, ethyl cellulose) and a synthetic resin. It is preferred that the synthetic resin is insoluble or difficultly soluble. Examples of insoluble or difficultly soluble synthetic resins include poly(meth)acrylic esters, e.g., polyalkyl(meth)acrylate and polyalkoxyalkyl(meth) acrylate, polyglycidyl(meth)acrylate), poly(meth) acrylamide, polyvinyl esters (e.g., polyvinyl acetate), polyacrylonitrile, polyolefins (e.g., polyethylene), polystyrene, benzoguanamine resin, formaldehyde condensation polymer, epoxy resins, polyamides, polycarbonates, phenolic resins, polyvinyl carbazole and polyvinylidene chloride.

Copolymers which combine the monomers used in the above polymers, may also be used.

In the case of the aforesaid copolymers, a small amount of hydrophilic repeating units may be included. Examples of monomers which form a hydrophilic repeating unit are acrylic acid, methacrylic acid, α, β-unsaturated dicarboxylic acid, hydroxyalkyl(meth)acrylate, sulfoalkyl (meth)acrylate and styrene sulfonic acid.

Examples of organic matting agents are for example given in UK Patent No. 1055713, U.S. Pat. Nos. 1,939,213, 2,221,873, 2,268,662, 2,322,037, 2,376,005, 2,391,181, 2,701,245, 2,992,101, 3,079,257, 3,262,782, 3,443,946, 3,516,832, 3,539,344, 3,591,379, 3,754,924 and 3,767,448, and JP-A Nos. 49-106821, 57-14835.

Two or more types of solid particles may be used in combination. The average particle diameter of the solid particles is preferably from 1 μm to 100 μm, and more preferably from 4 μm to 30 μm. The amount of the solid particles is preferably from 0.01 g/m$^2$ to 0.5 g/m$^2$, and more preferably from 0.02 g/m$^2$ to 03 g/m$^2$.

The releasing agents for use in the toner-image-receiving layer of the present invention can also be derivatives, oxides, purified products, and mixtures of the aforementioned substances. These releasing agents may each have a reactive substituent.

To obtain satisfactory anti-offset properties and to allow the sheet to pass through a machine smoothly, the melting point of the releasing agent is preferably from 70° C. to 95° C., and more preferably from 75° C. to 90° C.

When an aqueous thermoplastic resin is used as the thermoplastic resin in the toner-image-receiving layer, water-dispersible releasing agents are specifically preferred for higher miscibility with the aqueous thermoplastic resin.

The content of the releasing agent is preferably from 0.1% by mass to 10% by mass, more preferably from 0.3% by mass to 8.0% by mass, and more preferably form 0.5% by mass to 5.0% by mass of the total mass of the toner-image-receiving layer.

Other Components

The other components include additives for improving the thermodynamic properties of the toner-image-receiving layer. Examples of such additives are coloring agents, plasticizers, fillers, crosslinking agents, charge control agents, emulsions, and dispersions.

Examples of coloring agents are optical whitening agents, white pigments, colored pigments and dyes.

The aforesaid optical whitening agent has absorption in the near-ultraviolet region, and is a compound which emits fluorescence at 400 nm to 500 nm. The various optical whitening agents known in the art may be used without any particular limitation. As this optical whitening agent, the compounds described in "The Chemistry of Synthetic Dyes" Volume V, Chapter 8 edited by KVeenRataraman can conveniently be mentioned. Specific examples are stilbene compounds, coumarin compounds, biphenyl compounds, benzo-oxazoline compounds, naphthalimide compounds, pyrazoline compounds and carbostyril compounds. Examples of these are white furfar-PSN, PHR, HCS, PCS, B from Sumitomo Chemicals, and UVITEX-OB from Ciba-Geigy.

Examples of white pigments are the inorganic pigments (e.g., titanium oxide, calcium carbonate, etc.).

Examples of organic pigments are various pigments and azo pigments described in JP-A No. 63-44653, (e.g., azo lakes such as carmine 6B and red 2B, insoluble azo compounds such as mono-azo yellow, pyrazolo orange and Vulcan Orange, and condensed azo compounds such as chromophthal yellow and chromophthal red), polycyclic pigments (e.g., phthalocyanines such as copper phthalocyanine blue and copper phthalocyanine green), thioxadines such as thioxadine violet, isoindolinones such as isoindolinone yellow, surenes such as perylene, perinon, hulavanthoron and thioindigo, lake pigments (e.g., Malachite Green, Rhodamine B, Rhodamine G and Victoria Blue B), and inorganic pigments (e.g., oxides, titanium dioxide and red ocher, sulfates such as precipitated barium sulfate, carbonates such as precipitated calcium carbonates, silicates such as water-containing silicates and anhydrous silicates, metal powders such as aluminum powder, bronze powder and zinc dust, carbon black, chrome yellow and Berlin blue). One of these may be used alone, or two or more may be used in conjunction. Of these, titanium oxide is particularly preferred as the pigment.

There is no particular limitation on the form of the pigment, but hollow particles are preferred from the viewpoint that they have excellent heat conduction properties (low heat conduction properties) during image fixing.

Any of known dyes can be used as the dye.

Examples of oil-soluble dyes are anthraquinone compounds and azo compounds.

Examples of water-insoluble dyes are vat dyes such as C.I.Vat violet 1, C.I.Vat violet 2, C.I.Vat violet 9, C.I.Vat violet 13, C.I.Vat violet 21, C.I.Vat blue 1, C.I.Vat blue 3, C.I.Vat blue 4, C.I.Vat blue 6, C.I.Vat blue 14, C.I.Vat blue 20 and C.I.Vat blue 35, disperse dyes such as C.I. disperse violet 1, C.I. disperse violet 4, C.I. disperse violet 10, C.I. disperse blue 3, C.I. disperse blue 7 and C.I. disperse blue 58, and oil-soluble dyes such as C.I. solvent violet 13, C.I. solvent violet 14, C.I. solvent violet 21, C.I. solvent violet 27, C.I. solvent blue 11, C.I. solvent blue 12, C.I. solvent blue 25 and C.I. solvent blue 55.

Colored couplers used in silver halide photography may also be used to advantage.

The amount of coloring agent in the aforesaid toner-image-receiving layer (surface) is preferably 0.1 g/m$^2$ to 8 g/m$^2$, but more preferably 0.5 g/m$^2$ to 5 g/m$^2$. If the amount of coloring agent is less than 0.1 g/m$^2$, the light transmittance in the toner-image-receiving layer is high, and if the amount of the aforesaid coloring agent exceeds 8 g/m$^2$, handling becomes more difficult due to cracks, and adhesion resistance.

The plasticizers can be any of known plasticizers for resins. The plasticizers serve to control fluidizing or softening of the toner image receiving layer by action of heat and pressure when the toner is fixed.

Typical disclosures of the plasticizers can be found in, for example, Kagaku Binran (Chemical Handbook), ed. by The Chemical Society of Japan, Maruzen Co., Ltd. Tokyo; Plasticizer, Theory and Application, edited and written by Koichi Murai and published by Saiwai Shobo; Volumes 1 and 2 of Studies on Plasticizer, edited by Polymer Chemistry Association; and Handbook on Compounding Ingredients for Rubbers and Plastics, edited by Rubber Digest Co.

Examples of the plasticizers include, for example, esters of the following acids; phthalic, phosphoric, fatty acids, abietic, adipic, sebacic, azelaic, benzoic, butyric, epoxidized fatty acids, glycolic, propionic, trimellitic, citric, sulfonic, carboxylic, succinic, maleic, fumaric, and stearic acid; amides including aliphatic amides and sulfonamides, ethers, alcohols, lactones, poly (ethylene oxide)s (refer to JP-A No. 59-83154, No. 59-178451, No. 59-178453, No. 59-178454, No. 59-178455, No. 59-178457, No. 62-174754, No. 62-245253, No. 61-209444, No. 61-200538, No. 62-8145, No. 62-9348, No. 62-30247, No. 62-136646, and No. 2-235694). The plasticizers can be used by mixing with the resins.

Polymer plasticizers having a relatively low molecular weight can also be used herein. The molecular weight of such a plasticizer is preferably lower than that of a resin to be plasticized and is preferably 15000 or less, and more preferably 5000 or less. When these polymer plasticizers are used, those of the same kind with the resin to be plasticized are preferred. For example, low-molecular-weight polyesters are preferably used for plasticizing a polyester resin. In addition, oligomers can be used as the plasticizers. In addition to the aforementioned compounds, the plasticizers are also commercially available under the trade names of, for example, Adekacizer PN-170 and PN-1430 from Asahi Denka Kogyo Co., Ltd.; PARAPLEX G-25, G-30 and G-40 from C.P. Hall Co.; Ester Gum 8L-JA, Ester R-95, Pentalin 4851, FK 115, 4820 and 830, Luisol 28-JA, Picolastic A75, Picotex LC and Crystalex 3085 from Rika Hercules Co.

The plasticizer can be freely used so as to mitigate stress and/or strain when the toner particles are embedded in the toner-image-receiving layer. Such strain includes, for example, physical strain such as elastic force and viscosity, and strain due to material balance in, for example, molecules, principle chains and/or pendant moieties of the binder.

The plasticizer may be finely dispersed, may undergo micro-phase separation into islands-in-sea structure or may be sufficiently dissolved or miscible with other components such as a binder in the layers.

The content of the plasticizer in the toner-image-receiving layer is preferably from 0.001% by mass to 90% by mass, more preferably from 0.1% by mass to 60% by mass, and further preferably from 1% by mass to 40% by mass.

The plasticizers can be used to control the slipping property leading to the improvement in the transport performance due to friction reduction, improve the anti-offset property during fixing (detachment of toner or layers onto the fixing means) or control the curling property and the charging property for a desirable latent toner image formation.

The filler may be an organic or inorganic filler, and reinforcers for binder resins, bulking agents and reinforcements known in the art may be used.

This filler may be selected by referring to "Handbook of Rubber and Plastics Additives" (ed. Rubber Digest Co.), "Plastics Blending Agents—Basics and Applications" (New Edition) (Taisei Co.) and "The Filler Handbook" (Taisei Co.).

As the filler, various inorganic fillers (or pigments) can be used. Examples of inorganic pigments are silica, alumina, titanium dioxide, zinc oxide, zirconium oxide, micaceous iron oxide, white lead, lead oxide, cobalt oxide, strontium chromate, molybdenum pigments, smectite, magnesium oxide, calcium oxide, calcium carbonate and mullite. Silica and alumina are particularly preferred. One of these fillers may be used alone, or two or more may be used in conjunction. It is preferred that the filler has a small particle diameter. If the particle diameter is large, the surface of the toner-image-receiving layer tends to become rough.

Silica includes spherical silica and amorphous silica. The silica may be synthesized by the dry method, wet method or aerogel method. The surface of the hydrophobic silica particles may also be treated by trimethylsilyl groups or silicone. Colloidal silica is preferred. The average mean particle diameter of the silica is preferably 200 nm to 5000 nm.

The silica is preferably porous. The average pore size of porous silica is preferably 4 nm to 120 nm, but more preferably 4 nm to 90 nm. Also, the average pore volume per mass of porous silica is preferably 0.5 ml/g to 3 ml/g, for example.

Alumina includes anhydrous alumina and hydrated alumina. Examples of crystallized anhydrous aluminas which may be used are $\alpha$, $\beta$, $\gamma$, $\delta$, $\xi$, $\eta$, $\theta$, $\kappa$, $\rho$ or $\chi$. Hydrated alumina is preferred to anhydrous alumina. The hydrated alumina may be a monohydrate or trihydrate. Monohydrates include pseudo-boehmite, boehmite and diaspore. Trihydrates include gypsite and bayerite. The average particle diameter of alumina is preferably 4 nm to 300 nm, but more preferably 4 nm to 200 nm. Porous alumina is preferred. The average pore size of porous alumina is preferably 50 nm to 500 nm. The average pore volume per mass of porous alumina is of the order of 0.3 ml/g to 3 ml/g.

The alumina hydrate can be synthesized by the sol-gel method wherein ammonia is added to an aluminum salt solution to precipitate alumina, or by hydrolysis of an alkali aluminate. Anhydrous alumina can be obtained by dehydrating alumina hydrate by the action of heat.

The filler is preferably from 5 parts by mass to 2000 parts by mass relative to 100 parts of the dry mass of the binder of a layer to which it is added.

A crosslinking agent can be added in order to adjust the storage stability or thermoplastic properties of the toner-image-receiving layer. Examples of this crosslinking agent are compounds containing two or more reactive groups in the molecule such as epoxy, isocyanate, aldehyde, active halogen, active methylene, acetylene and other reactive groups known in the art.

The crosslinking agent may also be a compound having two or more groups able to form bonds such as hydrogen bonds, ionic bonds or coordination bonds.

The crosslinking agent may be a compound known in the art such as a resin coupling agent, curing agent, polymerizing agent, polymerization promoter, coagulant, film-forming agent or film-forming assistant.

Examples of coupling agents are chlorosilanes, vinylsilanes, epoxisilanes, aminosilanes, alkoxyaluminum chelates, titanate coupling agents or other agents known in the art such as those mentioned in "Handbook of Rubber and Plastics Additives" (ed. Rubber Digest Co.).

The toner-image-receiving layer preferably further comprises a charge control agent for controlling transfer and application of the toner and for preventing adhesion of the toner-image-receiving layer due to electricity. The charge control agent may be any charge control agent known in the art, i.e., surfactants such as cationic surfactants, anionic surfactants, amphoteric surfactants, non-ionic surfactants, and polymer electrolytes or electroconducting metal oxides. Examples of the surfactants are cationic charge inhibitors such as quarternary ammonium salts, polyamine derivatives, cation-modified polymethylmethacrylate, cation-modified polystyrene, anionic charge inhibitors such as alkyl phosphates and anionic polymers, or non-ionic charge inhibitors such as polyethylene oxide. When the toner has a negative charge, cationic charge inhibitors and non-ionic charge inhibitors are preferred.

When the toner is negatively charged, the charge control agent for use in the toner-image-receiving layer is preferably cationic or nonionic.

Examples of electroconducting metal oxides are ZnO, $TiO_2$, $SnO_2$, $Al_2O_3$, $In_2O_3$, $SiO_2$, MgO, BaO and $MoO_3$. Each of these metal oxides can be used alone or in combination in the form of a complex oxide.

Also, the electroconducting metal oxide may contain other elements, for example ZnO may contain Al or In, $TiO_2$ may contain Nb or Ta, and $SnO_2$ may contain Sb, Nb or halogen elements (doping).

The materials used to obtain the toner-image-receiving layer of the present invention may also contain various additives to improve stability of the output image or improve stability of the toner-image-receiving layer itself. Examples of additives are not specifically limited, can be selected according to the purpose and are antioxidants, age resistors, degradation inhibitors, anti-ozone degradation inhibitors, ultraviolet light absorbers, metal complexes, light stabilizers or preservatives.

Examples of antioxidants are chroman compounds, coumarane compounds, phenol compounds (e.g., hindered phenols), hydroquinone derivatives, hindered amine derivatives and spiroindan compounds. Antioxidants are given for example in JP-A No. 61-159644.

Examples of age resistors are given in "Handbook of Rubber and Plastics Additives", Second Edition (1993, Rubber Digest Co.), p76–121.

Examples of ultraviolet light absorbers are benzotriazo compounds (U.S. Pat. No. 3,533,794), 4-thiazolidone compounds (U.S. Pat. No. 3,352,681), benzophenone compounds (JP-A No. 46-2784) and ultraviolet light absorbing polymers (JP-A No. 62-260152).

Examples of metal complexes are given in U.S. Pat. Nos. 4,241,155, 4,245,018, 4,254,195, and JP-A Nos. 61-88256, 62-174741, 63-199248, 01-75568, 01-74272.

Photographic additives known in the art may also be added to the material used to obtain the toner-image-receiving layer as described above. Examples of photographic additives are given in the Journal of Research Disclosure (hereafter referred to as RD) No. 17643 (December 1978), No. 18716 (November 1979) and No. 307105 (November 1989), the relevant sections being summarised below.

| Type of additive | RD17643 | RD18716 | RD307105 |
|---|---|---|---|
| 1. Whitener | p24 | p648, right-hand column | p868 |
| 2. Stabilizer | pp. 24–25 | p649, right-hand column | pp. 868–870 |
| 3. Light absorbers (ultraviolet ray absorbers) | pp. 25–26 | p649, right-hand column | p873 |
| 4. Pigment image stabilizers | p25 | p650, right-hand column | p872 |
| 5. Film-hardening agents | p26 | p651, left-hand column | pp. 874–875 |
| 6. Binders | p26 | p651, left-hand column | pp. 873–874 |
| 7. Plasticizers, lubricants | p27 | p650, right-hand column | p876 |
| 8. Coating assistants (surfactants) | pp. 26–27 | p650, right-hand column | pp. 875–876 |
| 9. Antistatic agents | p27 | p650, right-hand column | pp. 867–877 |
| 10. Matting agents | | | pp. 878–879 |

The toner-image-receiving layer of the present invention is prepared by applying a coating composition containing a polymer for use in the toner-image-receiving layer using, for example, a wire coater, and drying the coated layer. The coating composition is prepared, for example, by dissolving or homogeneously dispersing a thermoplastic polymer, and additives such as a plasticizer in an organic solvent such as alcohols and ketones. Organic solvents for use herein include, but are not limited to, methanol, isopropyl alcohol, and methyl ethyl ketone. If the polymer for use in the toner-image-receiving layer is soluble in water, the toner-image-receiving layer can be prepared by applying an aqueous solution of the polymer onto the support. If not, the toner-image-receiving layer can be prepared by applying an aqueous dispersion of the polymer onto the support.

The film-forming temperature of the polymer for use in the present invention is preferably room temperature or higher for better storage before printing, and is preferably 100° C. or lower for better image-fixing of the toner particles.

The toner-image-receiving layer of the present invention is coated so that the coating mass after drying is for example 1 g/m$^2$ to 20 g/m$^2$, but preferably 4 g/m$^2$ to 15 g/m$^2$.

There is no particular limitation on the thickness of the toner-image-receiving layer, but it is preferably 1 $\mu$m to 30 $\mu$m and more preferably 2 $\mu$m to 20 $\mu$m.

[Physical Properties of Toner-image-receiving Layer]

The 180-degree peel strength of the toner-image-receiving layer with a fixing member is preferably 0.1 N/25-mm or less, and more preferably 0.041 N/25-mm or less at an image-fixing temperature. The 180-degree peel strength can be determined according to a method specified in JIS K 6887 using a surface material of the fixing member.

It is preferred that the toner-image-receiving layer has a high degree of whiteness. This whiteness is measured by the method specified in JIS P 8123, and is preferably 85% or more. It is preferred that the spectral reflectance is 85% or more in the wavelength region of 440 nm to 640 nm, and that the difference between the maximum spectral reflectance and minimum spectral reflectance in this wavelength range is within 5%. Further, it is preferred that the spectral reflectance is 85% or more in the wavelength region of 400 nm to 700 nm, and that the difference between the maximum spectral reflectance and minimum spectral reflectance in this wavelength range is within 5%.

Specifically, regarding the whiteness, the L* value is preferably 80 or higher, preferably 85 or higher and still more preferably 90 or higher in a CIE 1976 (L*a*b*) color space. The tone of the white color should preferably be as neutral as possible. Regarding the whiteness tone, the value of $(a^*)^2+(b^*)^2$ is preferably 50 or less, more preferably 18 or less and still more preferably 5 or less in a (L*a*b*) space.

It is preferred that the toner-image-receiving layer has high gloss. The gloss is 45, preferably 60 or higher, more preferably 75 or higher and still more preferably 90 or higher over the whole range from white where there is no toner, to black where there is maximum density.

However, the gloss is preferably less than 110. If it exceeds 110, the image has a metallic appearance which is undesirable.

Gloss may be measured based on JIS Z 8741.

It is preferred that the toner-image-receiving layer has a high smoothness. The arithmetic mean roughness (Ra) is preferably 3 $\mu$m or less, more preferably 1 $\mu$m or less and still more preferably 0.5 $\mu$m or less over the whole range from white where there is no toner, to black where there is maximum density.

Arithmetic mean roughness may be measured based on JIS B 0601, JIS B 0651 and JIS B 0652.

It is preferred that the toner-image-receiving layer has one of the following physical properties, more preferred that it has several of the following physical properties, and most preferred that it has all of the following physical properties.

(1) The melting temperature Tm of the toner-image-receiving layer is preferably 30° C. or higher and [(Tm of the toner)+20° C.] or lower.

(2) The temperature at which the viscosity of the toner-image-receiving layer is $1\times10^5$ cp is 40° C. or higher and lower than that of the toner.

(3) The storage modulus G' of the toner-image-receiving layer is preferably from $1\times10^2$ Pa to $1\times10^5$ Pa and the loss modulus (G")thereof is preferably from $1\times10^2$ Pa to $1\times10^5$ Pa at an image-fixing temperature.

(4) The loss tangent G"/G' as the ratio of the loss modulus G" to the storage modulus G' of the toner-image-receiving layer at an image-fixing temperature is preferably from 0.01 to 10.

(5) The storage modulus G' of the toner-image-receiving layer at an image-fixing temperature preferably falls in a range of −50 to +2500 of the storage modulus G" of the toner at the image-fixing temperature.

(6) A melted toner forms an inclination with the toner-image-receiving layer of preferably 50 degrees or less and more preferably 40 degrees or less.

The toner-image-receiving layer preferably also satisfies the physical properties given in Japanese Patent No. 2788358, and JP-A Nos. 07-248637, 08-305067 and 10-239889.

It is preferred that the surface electrical resistance of the toner-image-receiving layer is within the range of $1\times10^6$ $\Omega/cm^2$ to $1\times10^{15}$ $\Omega/cm^2$ (under conditions of 25° C., 65% RH).

If the surface electrical resistance is less than $1\times10^6$ $\Omega/cm^2$, the toner amount transferred to the toner-image-receiving layer is insufficient, and the density of the toner image obtained may be too low. On the other hand, if the surface electrical resistance exceeds $1\times10^{15}$ $\Omega/cm^2$, more charge than necessary is produced during transfer, toner is transferred insufficiently, image density is low and static electricity develops causing dust to adhere during handling of the image-receiving sheet for electrophotography, or misfeed, overfeed, discharge marks or toner transfer dropout may occur.

Also, the surface electrical resistance of the surface on the opposite side of the carrier to the toner-image-receiving layer is preferably $5\times10^8$ $\Omega/cm^2$ to $3.2\times10^{10}$ $\Omega/cm^2$, and more preferably $1\times10^9$ $\Omega/cm^2$ to $1\times10^{10}$ $\Omega/cm^2$.

The aforesaid surface electrical resistances were measured based on JIS K 6911. The sample was left with air-conditioning for 8 hours or more at a temperature of 20° C. and humidity 65%. Measurements were made using an Advantest Ltd. R8340 under the same environmental conditions after passing a current for 1 minute at an applied voltage of 100V.

Additional Layers

Other layers may for example include a surface protective layer, back layer, interlayer, contact improving layer, undercoat layer, cushioning layer, charge-control or antistatic layer, reflective layer, color-control layer, storage-stability improving layer, adhesion preventing layer, anticurling layer, and smoothing layer. These layers may be used alone, or two or more may be used in combination.

The surface protective layer may be arranged on the surface of the toner-image-receiving layer in order to protect the surface, to improve the storage stability, to improve the handleability, to impart writability to the sheet, to enable the sheet to pass through an apparatus more smoothly, and to impart anti-offset performance to the sheet. The surface protective layer can be a single layer or a multilayer. It may comprise any of thermoplastic resins, thermosetting resins, and other resins as a binder and preferably comprises a resin or polymer of the same type with that in the toner-image receiving layer. The thermodynamic properties, electrostatic properties, and other properties of the surface protective layer are not necessary to be the same with those of the toner-image-receiving layer and can be optimized, respectively.

The surface protective layer may comprise any of additives which can be used in the toner-image-receiving layer. In particular, the surface protective layer preferably comprises, in addition to the releasing agent, other additives such as a matting agent. Such matting agents can be those conventionally used.

The outermost surface (e.g., the surface protective layer, if any) of the electrophotographic image-receiving sheet is preferably satisfactorily miscible or compatible with the toner for better image-fixing properties. More specifically, the contact angle between the outermost surface and a fused toner is preferably from 0 degree to 40 degrees.

The back layer (backside layer) is preferably arranged on the back side (an opposite side to the toner-image-receiving layer) of the electrophotographic image-receiving sheet in order to enable the back side to receive images, to improve the quality of the images formed on the back side, to improve curling balance, and/or to enable the sheet to pass through an apparatus more smoothly.

The color of the back layer is not specifically limited. When the electrophotographic image-receiving sheet is an image-receiving sheet capable of receiving images on both sides, the back layer is preferably white. The back layer preferably has a whiteness and a spectroscopic reflectance of 85% or more as in the front side (the toner-image-receiving layer side).

The back layer may have the same configuration as the toner-image-receiving layer in order to enable the both sides to receive or form images more satisfactorily. The back layer may further comprise any of the aforementioned additives, of which matting agents, and charge control agents are preferably used. The back layer can be a single layer or a multilayer.

When a releasing oil is used in a fixing roller and other members to prevent offset during the image-fixing, the back layer is preferably capable of absorbing oils.

The adhesion improving layer is preferably arranged in the electrophotographic image-receiving sheet to improve adhesion between the support and the toner-image-receiving layer. The adhesion improving layer may comprise any of the aforementioned additives, of which crosslinking agents are preferably used. The electrophotographic image-receiving sheet may have a cushioning layer between the adhesion improving layer and the toner-image-receiving layer to enable the sheet to receive the toner more satisfactorily.

The interlayer may be arranged, for example, between the support and adhesion improving layer, between the adhesion improving layer and the cushioning layer, between the cushioning layer and the toner-image-receiving layer, and/or between the toner-image-receiving layer and the storage stability improving layer. When the electrophotographic image-receiving sheet comprises the support, the toner-image-receiving layer, and the interlayer, the interlayer can be arranged, for example, between the support and the toner-image-receiving layer.

There is no particular limitation on the thickness of the electrophotographic image-receiving sheet of the present invention, which may be suitably selected according to the purpose, but it is for example preferably 50 $\mu$m to 350 $\mu$m, and more preferably 100 $\mu$m to 280 $\mu$m.

<Toner>

In the electrophotographic image-receiving sheet of the present invention, the toner-image-receiving layer receives toner during printing or copying.

The toner contains at least a binder resin and a coloring agent, but may contain releasing agents and other components as necessary.

Toner Binder Resin

Examples of the toner binder resin are styrenes such as styrene or parachlorostyrene; vinyl esters such as vinyl naphthalene, vinyl chloride, vinyl bromide, vinyl fluoride, vinyl acetate, vinyl propioniate, vinyl benzoate and vinyl butyrate; methylene aliphatic carboxylates such as methyl acrylate, ethyl acrylate, n-butyl acrylate, isobutyl acrylate, dodecyl acrylate, n-octyl acrylate, 2-chloroethyl acrylate, phenyl acrylate, methyl α-chloroacrylate, methyl methacrylate, ethyl methacrylate and butyl acrylate; vinyl nitriles such as acryloniotrile, methacrylonitrile and acrylamide; vinyl ethers such as vinyl methyl ether, vinyl ethyl ether and vinyl isobutyl ether; N-vinyl compounds such as N-vinyl pyrrole, N-vinylcarbazole, N-vinyl indole and N-vinyl pyrrolidone; and vinyl carboxylic acids such as methacrylic acid, acrylic acid and cinnamic acid. These vinyl monomers may be used alone, or their copolymers may be used. In addition, various polyesters may be used, and various waxes may be used in conjunction.

Of these resins, it is preferable to use a resin of the same type as the resin used for the toner-image-receiving layer of the present invention.

Toner Coloring Agents

The coloring agents generally used in the art can be used without limitation. Examples are carbon black, chrome yellow, Hanzer yellow, benzidine yellow, thuren yellow, quinoline yellow, permanent orange GTR, pyrazolone orange, Vulcan Orange, watch young red, permanent red, Brilliant Carmine 3B, Brilliant Carmine 6B, Du Pont Oil Red, pyrazolone red, lithol red, rhodamine B lake, lake red C, rose bengal, aniline blue, ultramarine blue, chalco oil blue, methylene blue chloride, phthalocyanine blue, phthalocyanine green and malachite green oxalate. Various dyes may also be added such as acridine, xanthene, azo, benzoquinone, azine, anthraquinone, thioindigo, dioxazine, thiazine, azomethine, indigo, thioindigo, phthalocyanine, aniline black, polymethane, triphenylmethane, diphenylmethane, thiazine, thiazole and xanthene. These coloring agents may be used alone, or plural coloring agents may be used together.

It is preferred that the amount of coloring agent is within the range of 2% by mass to 8% by mass. If the amount of coloring agent is more than 2% by mass, the coloration does not become weaker, and if it is less than 8% by mass, transparency is not lost.

Toner Releasing Agent

The releasing agent may in principle be any of the waxes known in the related art, but polar waxes containing nitrogen such as highly crystalline polyethylene wax of relatively low molecular weight, Fischer-Tropsch wax, amide wax and urethane wax are particularly effective. For polyethylene wax, it is particularly effective if the molecular weight is less than 1000, but a range of 300 to 1000 is more preferred.

Compounds containing urethane bonds have a solid state due to the strength of the cohesive force of the polar groups even if the molecular weight is low, and as the melting point can be set high in view of the molecular weight, they are convenient. The preferred range of molecular weight is 300 to 1000. The starting materials may be selected from various combinations such as a di-isocyanate acid compound with a mono-alcohol, a mono-isocyanic acid with a mono-alcohol, a dialcohol with a mono-isocyanic acid, a tri-alcohol with a mono-isocyanic acid, and a tri-isocyanic acid compound with a mono-alcohol. To prevent increase of molecular weight, it is preferred to use a combination of compounds with polyfunctional groups and monofunctional groups, and it is important to use equivalent amounts of functional groups.

Among the starting materials, examples of mono-isocyanic acid compounds are dodecyl isocyanate, phenyl isocyanate and its derivatives, naphthyl isocyanate, hexyl isocyanate, benzyl isocyanate, butyl isocyanate and allyl isocyanate.

Examples of di-isocyanic acid compounds are tolylene di-isocyanate, 4,4' diphenylmethane di-isocyanate, toluene di-isocyanate, 1,3-phenylene di-isocyanate, hexamethylene di-isocyanate, 4-methyl-m-phenylene di-isocyanate and isophorone di-isocyanate.

Examples of mono-alcohols which may be used are very ordinary alcohols such as methanol, ethanol, propanol, butanol, pentanol, hexanol and heptanol.

Among the starting materials, examples of di-alcohols are numerous glycols such as ethylene glycol, diethylene glycol, triethylene glycol, trimethylene glycol; and examples of tri-alcohols are trimethylol propane, triethylol propane and trimethanolethane, but the invention is not necessarily limited this range.

These urethane compounds may be mixed with the resin or coloring agent during kneading as in the case of an ordinary releasing agent, and used also as a kneaded, crushed toner. Further, in the case of an emulsion polymerization cohesion scorification toner, they may be dispersed in water together with an ionic surfactant, polymer acid or polymer electrolyte such as a polymer base, heated above the melting point, and converted to fine particles by applying an intense shear in a homogenizer or pressure discharge dispersion machine to manufacture a releasing agent particle dispersion of 1 μm or less, which can be used together with a resin particle dispersion or coloring agent dispersion.

Toner Other Components

The toner may of the present invention also contain other components such as internal additives, charge control agents and inorganic particles. Examples of internal additives are metals such as ferrite, magnetite, reduced iron, cobalt, nickel and manganese, alloys or magnetic bodies such as compounds containing these metals.

The various charge control agents which are generally used may also be employed here, such as quartenary ammonium salts, nigrosine compounds, dyes from complexes of aluminum, iron and chromium, or triphenylmethane pigments. Materials which are difficulty soluble in water are preferred from the viewpoint of control of ionic strength which affects cohesion and stability during melting, and of less waste water pollution.

The inorganic fine particles may be any of the external additives for toner surfaces generally used, such as silica, alumina, titania, calcium carbonate, magnesium carbonate or tricalcium phosphate, it being preferred to disperse these with an ionic surfactant, polymer acid or polymer base.

Surfactants can also be used for emulsion polymerization, seed polymerization, pigment dispersion, resin particle dispersion, releasing agent dispersion, cohesion or stabilization thereof. Examples are anionic surfactants such as sulfuric acid ester salts, sulfonic acid salts, phosphoric acid esters or soaps, and cationic surfactants such as amine salts and quartenary ammonium salts. It is also effective to use non-ionic surfactants such as polyethylene glycols, alkylphenol ethylene oxide additives or polybasic alcohols. These may generally be dispersed by a rotary shear homogenizer or a ball mill, sand mill or dyno mill containing the media.

The toner may also contain an external additive if necessary. Examples of this additive are inorganic powders and organic particles. Examples of inorganic particles are $SiO_2$, $TiO_2$, $Al_2O_3$, CuO, ZnO, $SnO_2$, $Fe_2O_3$, MgO, BaO, CaO, $K_2O$, $Na_2O$, $ZrO_2$, CaO—$SiO_2$, $K_2O$—$(TiO_2)_n$, $Al_2O_3$-$2SiO_2$, $CaCO_3$, $MgCO_3$, $BaSO_4$ and $MgSO_4$. Examples of organic particles are fatty acids and their derivatives, powdered metal salts thereof, and resin powders of fluorine resins, polyethylene resin and acrylic resins. The average particle diameter of these powders may for example be 0.01 μm to 5 μm, but is preferably 0.1 μm to 2 μm.

There is no particular limitation on the method of manufacturing the toner, but it is preferably manufactured by a method comprising the steps of (i) forming cohesive particles in a dispersion of resin particles to manufacture a cohesive particle dispersion, (ii) adding a fine particle dispersion to the aforesaid cohesive particle dispersion so that the fine particles adhere to the cohesive particles, thus forming adhesion particles, and (iii) heating the aforesaid adhesion particles which melt to form toner particles.

Toner Physical Properties

It is preferred that the volume average particle diameter of the toner is from 0.5 μm to 10 μm.

If the volume average particle diameter of the toner is too small, it may have an adverse effect on handling of the toner (supplementation, cleaning properties and flow properties), and particle productivity may decline. On the other hand, if the volume average particle damage is too large, it may have an adverse effect on image quality and resolution due to granularity and transfer properties.

It is preferred that the toner of the present invention satisfies the aforesaid toner volume average particle diameter range, and that the volume average particle distribution index (GSDv) is 1.3 or less.

It is preferred that the ratio (GSDv/GSDn) of the volume average polymer distribution index (GSDv) and number average particle distribution index (GSDn) is 0.95 or more.

It is preferred that the toner of the present invention satisfies the aforesaid volume average particle diameter range, and that the average value of the shape coefficient represented by the following equation is 1.00 to 1.50.

$$\text{Shape coefficient}=(\pi\times L^2)/(4\times S)$$

In equation, L is the maximum length of the toner particles, and S is the projection surface area of a toner particle.

If the toner satisfies the above conditions, it has a desirable effect on image quality, and in particular, granularity and resolution. Also, there is less risk of dropout and blur accompanying transfer, and less risk of adverse effect on handling properties even if the average particle diameter is small.

The storage modulus G' (measured at an angular frequency of 10 rad/sec) of the toner itself at 150° C. is 10 to 200 Pa, which is convenient for improving image quality and preventing offset in the fixing step.

<Belt Fixing and Smoothing Apparatus>

The belt fixing and smoothing apparatus comprises a hot-pressing member, a belt member, a cooling device, and a cooling-releasing section and may further comprise other members according to necessity.

The hot-pressing member includes, but is not specifically limited to, a combination of a heating roller, a pressure roller, and an endless belt. The cooling device includes, but is not specifically limited to, cooling units that can supply cooling air and can control a cooling temperature and other conditions, and heatsinks.

The cooling-releasing section is not specifically limited, can be set according to the purpose and means a position in the vicinity of a tension roller where the electrophotographic image-receiving sheet is peeled off from the belt by action of its rigidity.

When the electrophotographic image-receiving sheet is brought into contact with the hot-pressing member of the belt fixing and smoothing apparatus, it is preferably pressurized. The sheet can be pressurized by any technique and is preferably pressurized by the application of a nip pressure. The nip pressure is preferably from 1 kgf/cm$^2$ to 100 kgf/cm$^2$ and more preferably form 5 kgf/cm$^2$ to 30 kgf/cm$^2$ for the formation of images with excellent water resistance, high surface smoothness and good gloss. The heating temperature in the hot-pressing member is equal to or higher than the softening point of the thermoplastic resin in the image-forming layer (toner-image-receiving layer), depends on the type of the thermoplastic resin but is generally preferably from 80° C. to 200° C. The cooling temperature in the cooling device is preferably 80° C. or lower and more preferably from 20° C. to 80° C. for the sufficient solidification of the thermoplastic resin layer in the toner-image-receiving layer.

The belt member in the belt fixing and smoothing apparatus comprises a heat-resistant support film and a releasing layer arranged on the support film.

The support film is not specifically limited, as long as it has heat resistance, and is, for example, a film of a polyimide (PI), a poly(ethylene naphthalate) (PEN), a poly(ethylene terephthalate) (PET), a poly(ether ether ketone) (PEEK), a poly(ether sulfone) (PES), a poly(ether imide) (PEI), or a poly(parabanic acid) (PPA).

The releasing layer preferably comprises at least one of silicone rubbers, fluorocarbon rubbers, fluorocarbonsiloxane rubbers, silicone reins, and fluorocarbon resins. The belt member more preferably has a layer comprising a fluorocarbonsiloxane rubber on its surface, and further preferably has a layer comprising a silicone rubber on its surface, which silicone rubber layer has a layer comprising a fluorocarbonsiloxane rubber on its surface.

It is preferred that the fluorocarbon siloxane rubber has a perfluoroalkyl ether group and/or a perfluoroalkyl group in the main chain.

As the fluorocarbon siloxane rubber, a curing material comprising a fluorocarbon siloxane rubber composition containing the components (A) to (D) below are preferred. (A) a fluorocarbon polymer having a fluorocarbon siloxane of the following general formula (1) below as its main component, and containing aliphatic unsaturated groups, (B) an organopolysiloxane and/or fluorocarbon siloxane containing two or more ≡SiH groups in the molecule, and 1 to 4 times the molar amount of ≡SiH groups more than the amount of aliphatic unsaturated groups in the aforesaid fluorocarbon siloxane rubber, (C) a filler, and (D) an effective amount of catalyst.

The fluorocarbon polymer of Component (A) comprises a fluorocarbon siloxane containing a repeated unit expressed by the following General Formula (1) as its main component, and contains aliphatic unsaturated groups.

General Formula (1)

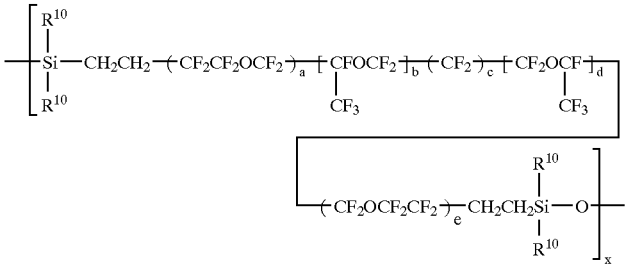

Herein, in the General Formula (1), $R^{10}$ is a non-substituted or substituted monofunctional hydrocarbon group containing 1 to 8 carbon atoms, preferably an alkyl group containing 1 to 8 carbon atoms or an alkenyl group containing 2 to 3 carbon atoms, and particularly preferably a methyl group.

"a" and "e" are, independent of the other, an integer of 0 or 1. "b" and "d" are independently an integer of 1 to 4. "c" is an integer of from 0 to 8. "x" is preferably 1 or greater, and more preferably from 10 to 30.

An example of this Component (A) include a substance expressed by the following General Formula (2):

General Formula (2)

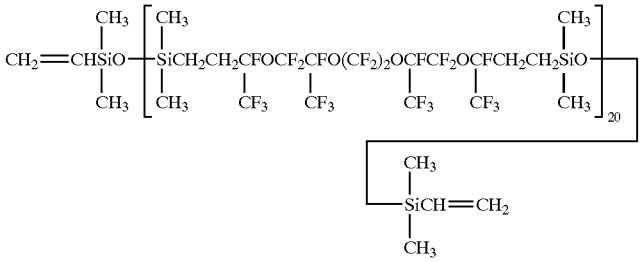

In Component (B), one example of the organopolysiloxane comprising SiH groups is an organohydrogenpolysiloxane having at least two hydrogen atoms bonded to silicon atoms in the molecule.

Examples of these organohydrogenpolysiloxanes include the various organohydrogenpolysiloxanes used in an addition-curing silicone rubber composition.

It is generally preferred that the organohydrogenpolysiloxane is blended in such a proportion that the number of "SiH groups" therein is at least one, and particularly 1 to 5, relative to one aliphatic unsaturated hydrocarbon group in the fluorocarbon siloxane of Component (A).

It is preferred that in the fluorocarbon containing SiH groups, one unit of the General Formula (1) or $R^{10}$ in the General Formula (1) is a dialkylhydrogensiloxane group, the terminal group is an SiH group such as a dialkylhydrogensiloxane group, a silyl group, or the like. An example of the fluorocarbon includes those expressed by the following General Formula (3).

General Formula (3)

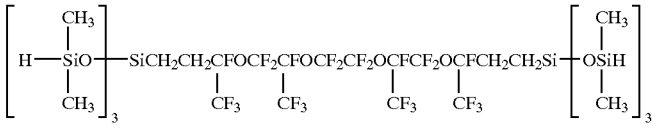

In the fluorocarbon siloxane rubber composition, when the organocarbon polymer of Component (A) comprises an aliphatic unsaturated group, the organohydrogenpolysiloxane is preferably used as a curing agent. That is, the cured product is formed by an addition reaction between aliphatic unsaturated groups in the fluorocarbon siloxane, and hydrogen atoms bonded to silicon atoms in the organohydrogenpolysiloxane.

The filler, which is Component (C), may be various fillers used in ordinary silicone rubber compositions. Examples of the filler include reinforcing fillers such as mist silica, precipitated silica, carbon powder, titanium dioxide, aluminum oxide, quartz powder, talc, sericite, bentonite, or the like; fiber fillers such as asbestos, glass fiber, organic fibers or the like.

Examples of the catalyst, which is Component (D), include those any known as an addition reaction catalyst in the art. Specific examples of the catalyst include chloroplatinic acid, alcohol-modified chloroplatinic acid, complexes of chloroplatinic acid and olefins, platinum black or palladium supported on a carrier such as alumina, silica, carbon, or the like, and Group VIII elements of the Periodic Table or compounds thereof such as complexes of rhodium and olefins, chlorotris(triphenylphosphine) rhodium (an Wilkinson catalyst), rhodium (III) acetyl acetonate, or the like. It is preferred to dissolve these complexes in an alcohol solvent, an ether solvent, a hydrocarbon solvent, or the like.

Various blending agents may be added to the fluorocarbon siloxane rubber composition to the extent that they do not interfere with the purpose of the invention which is to improve solvent resistance. For example, dispersing agents such as diphenylsilane diol, low polymer chain end hydroxyl group-blocked dimethylpolysiloxane and hexamethyl disilazane, heat resistance improvers such as ferrous oxide, ferric oxide, cerium oxide and octyl acid iron, and coloring agents such as pigments or the like, may be added as necessary.

The belt member can be obtained by coating the surface of the heat-resistant support film with the fluorocarbonsiloxane rubber composition and heating and curing the composition. Where necessary, the fluorocarbonsiloxane rubber composition is further diluted with a solvent such as m-xylene hexafluoride or benzotrifluoride to yield a coating liquid, and the coating liquid is applied to the film according to a conventional coating procedure such as spray coating, dip coating or knife coating. The heating and curing temperature and time can be selected depending on, for example, the type of the support film and the production method. The coated layer is generally heated and cured at a temperature of 100° C. to 500° C. for 5 seconds to 5 hours.

The thickness of the releasing layer arranged on the surface of the heat-resistant support film is not specifically limited but is preferably from 1 $\mu$m to 200 $\mu$m, and more preferably from 5 $\mu$m to 150 $\mu$m for better releasing of the toner, for inhibiting offset of the toner components and for better image-fixing properties.

Examples of the belt fixing system are a method described in JP-A No. 11-352819 wherein an oilless type belt is used and a method described in JP-A No. 11-231671 and JP-A No. 05-341666 wherein the secondary image transfer and the fixing are performed at the same time. An example of electrophotographic apparatus using the fixing belt for use in the present invention is an electrophotographic apparatus having a toner-image fixing unit using a belt. The apparatus includes at least a hot-pressing member, a belt member, and a cooling unit. The hot pressing member is capable of fusing and pressurizing a toner. The belt member is capable of conveying an image-receiving sheet bearing the toner while the belt is in contact with a toner-image-receiving layer of the sheet. The cooling unit is capable of freely cooling the heated image-receiving sheet while being attached to the fixing belt. By using the electrophotographic image-receiving sheet having the toner-image-receiving layer in the electrophotographic apparatus having the belt member, the toner attached to the toner-image-receiving layer can be fixed at a precise position without broadening in the image-receiving sheet. In addition, the fused toner is cooled and solidified while being in intimate contact with the belt member, and thus the toner-image-receiving layer receives the toner while the toner is completely embedded therein. Accordingly, the resulting toner image has no step and is glossy and smooth.

The electrophotographic image-receiving sheet for use in the present invention is suitable for an image forming process using an oilless belt, for significantly improving anti-offset properties. However, it can also be used in other image forming process satisfactorily.

For example, by using the electrophotographic image-receiving sheet, a full color image can be satisfactorily formed while improving the image quality and avoiding cracking. The color image can be formed using an electrophotographic apparatus capable of forming full color images. A regular electrophotographic apparatus comprises a conveying section for conveying an image-receiving sheet, a latent electrostatic image forming section, a development section arranged in the vicinity of the latent electrostatic image forming section, and an image-fixing section. Some of these apparatus further comprise an intermediate image transfer section at a center part thereof in the vicinity of the latent electrostatic image forming section and the conveying section.

For further improving the image quality, an adhesive transfer system or a heat-aided transfer system instead of, or in combination with, electrostatic transfer or bias roller transfer has been known. Specific configurations of these systems can be found in, for example, JP-A No. 63-113576 and JP-A No. 05-341666. A method using an intermediate image-transfer belt according to the heat-aided transfer system is preferred. The intermediate image-transfer belt preferably has a cooling device in a portion after image transfer procedure or in a latter half of image transfer procedure in which the toner is transferred to the electrophotographic image-receiving sheet. By action of the cooling device, the toner can be cooled to a temperature equal to or lower than the softening point or glass transition point of the binder resin used therein and can be efficiently peeled off from the intermediate image-transfer belt and transferred to the electrophotographic image-receiving sheet.

The fixing is an important step for the gloss and smoothness of the final image. For the fixing, a method wherein a hot-press roller is used and a method wherein a belt is used for image fixing are known. From the viewpoints of the image qualities such as gloss and smoothness, the belt fixing method is preferred. Examples of the belt fixing method are a method described in JP-A No. 11-352819 wherein an oilless type belt is used and a method described in JP-A No. 11-231671 and JP-A No. 05-341666 wherein the secondary image transfer and the fixing are performed at the same time. Before hot pressing using a fixing belt and a fixing roller, primary fixing with a heat roller may be performed.

Figure 3:
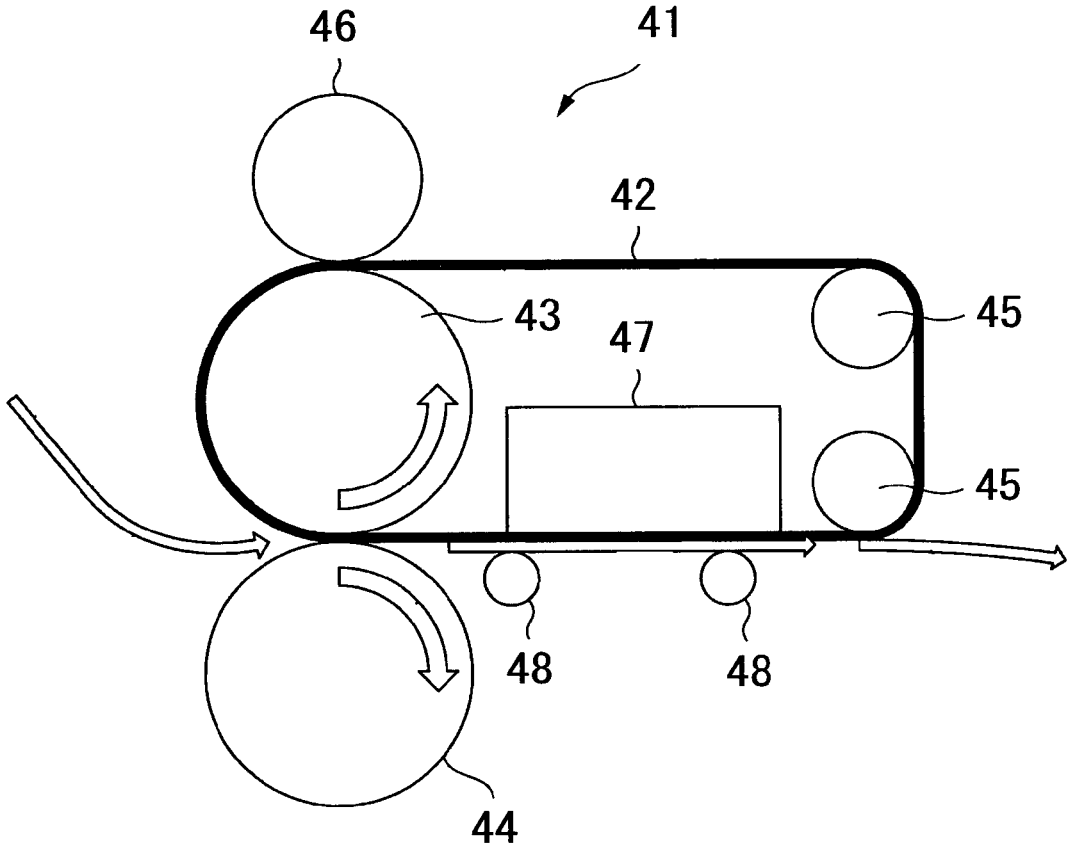
FIG. 3 is a schematic diagram showing an example of a belt fixing and smoothing apparatus of cooling and releasing system for use in the present invention.
Figure 5:
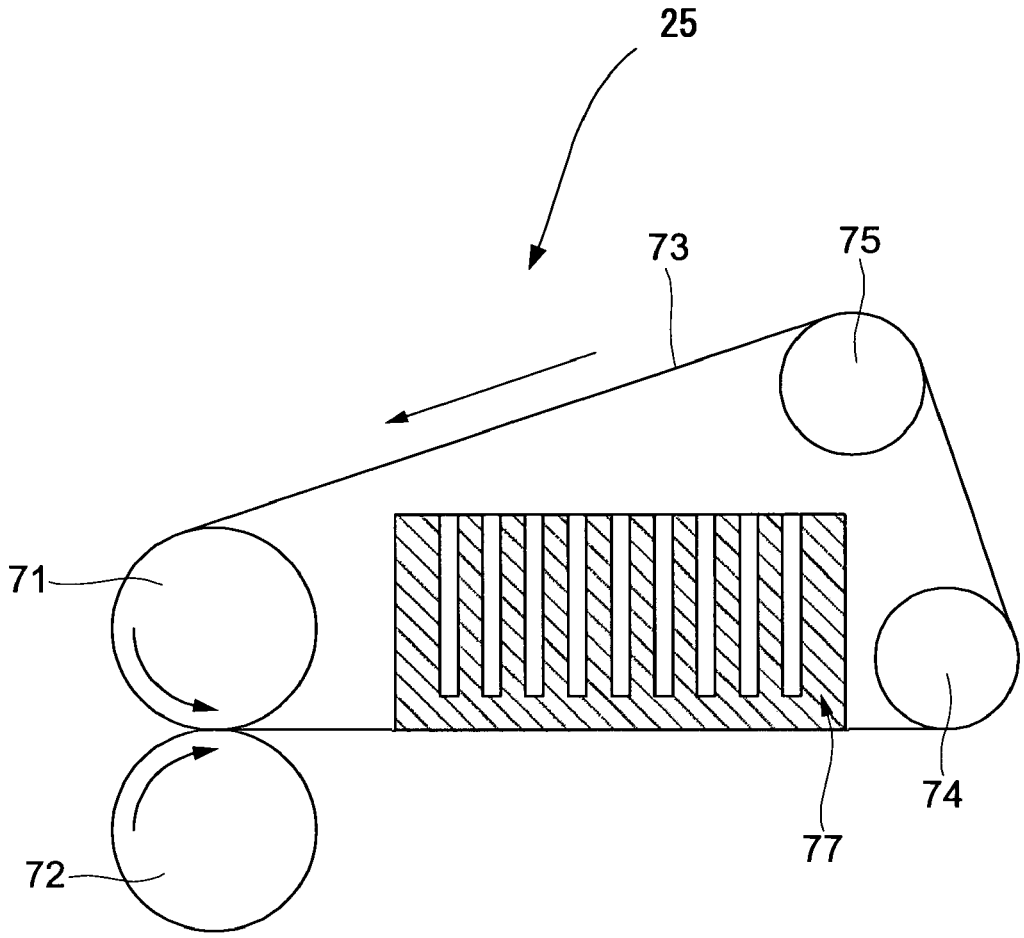
FIG. 5 is a schematic diagram showing an example of a belt fixing and smoothing apparatus of cooling and releasing system for use in Examples.

FIGS. 3 and 5 are examples of the belt fixing and smoothing apparatus. In the belt fixing and smoothing apparatus (endless press) of cooling and releasing system shown in FIG. 3, a processing section 41 includes a belt 42, a heating roller 43, a pressure roller 44, tension rollers 45, a cleaning roller 46, a cooling device 47, and conveying rollers 48.

The heating roller 43 and a pair of the tension rollers 45 are arranged inside the belt 42. The tension rollers 45 are arranged distant from the heating roller 43. The belt 42 is rotatably spanned among the heating roller 43 and the tension rollers 45. The pressure roller 44 is arranged in contact with the belt 42 and faces the heating roller 43. A portion between the pressure roller 44 and the belt 42 is pressurized by the pressure roller 44 and the heating roller 43 to thereby form a nip. The cooling device 47 is arranged inside the belt 42 between the heating roller 43 and one of the tension rollers 45. The heating roller 43 is disposed upstream in a rotating direction of the belt 42, and the one of the tension rollers 45 is disposed downstream thereof. The two conveying rollers 48 are arranged so as to face the cooling device 47 with the interposition of the belt 42. The distance between the two conveying rollers 48 is nearly equal to the distance between the nip and one of the conveying rollers 48 and the distance between the tension roller 45 and the other conveying roller 48. The cleaning roller 46 is arranged so as to face the heating roller 43 with the interposition of the belt 42 in an opposite side to the pressure roller 44. The portion between the cleaning roller 46 and the belt 42 is pressurized by the cleaning roller 46 and the heating roller 43. The heating roller 43, the pressure roller 44, the tension rollers 45, the cleaning roller 46, and the conveying rollers 48 synchronously rotate to thereby allow the belt 42 to revolve.

Figure 4:
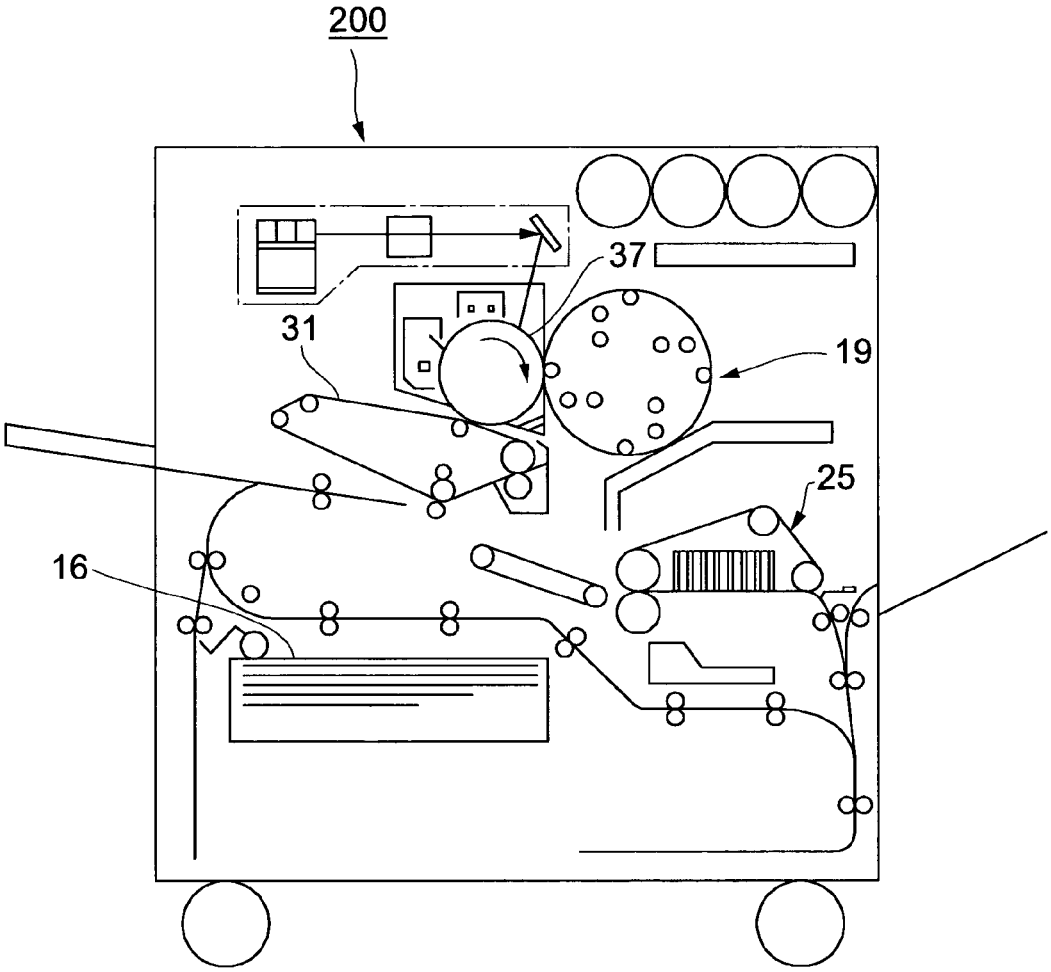
FIG. 4 is a schematic diagram showing an example of an electrophotographic apparatus for use in Examples.

The belt fixing and smoothing apparatus shown in FIG. 5 can be prepared by modifying a belt image-fixing device of an electrophotographic apparatus shown in FIG. 4 (e.g., a full color laser printer DCC-500 (trade name, available from Fuji Xerox Co., Ltd., Japan)).

The image forming apparatus 200 shown in FIG. 4 comprises a photoconductor drum 37, a development device 9, an intermediate image-transfer belt 31, a recording sheet 16, and the belt image-fixing device 25.

FIG. 5 shows the belt image-fixing device 25 arranged in the image forming apparatus 200 shown in FIG. 4.

With reference to FIG. 5, the belt image-fixing device 25 comprises a heating roller 71, a releasing roller 74, a tension roller 75, an endless belt 73, and a pressure roller 72 pressed to the heating roller 71 with the interposition of the endless belt 73. The endless belt is rotatably supported by the heating roller 71, the releasing roller 74, and the tension roller 75.

A cooling heatsink 77 is arranged inside the endless belt 73 between the heating roller 71 and the releasing roller 74. The cooling heatsink 77 serves to forcedly cool the endless belt 73 and constitutes a cooling and sheet conveying section for cooling and conveying an electrophotographic image-receiving sheet.

In the belt image-fixing device 25 as shown in FIG. 5, an electrophotographic image-receiving sheet bearing a transferred color toner image on its surface is introduced into a nip so that the color toner image faces the heat roller 71. The nip is a portion at which the heating roller 71 is pressed to the pressure roller 72 with the interposition of the endless belt 73. When the electrophotographic image-receiving sheet passes through the nip between the heating roller 71 and the pressure roller 72, the color toner image T is heated, fused and thereby fixed on the electrophotographic image-receiving sheet.

Specifically, the toner is substantially heated to a temperature of about 120° C. to about 130° C. in the nip between the heating roller 71 and the pressure roller 72 and is thereby fused, and thus the color toner image is fixed onto the image-receiving layer of the electrophotographic image-receiving sheet. The electrophotographic image-receiving sheet bearing the color toner image on the image-receiving layer is then conveyed with the endless belt 73 while its surface image-receiving layer is in intimate contact with the surface of the endless belt 73. During conveying, the endless belt 73 is forcedly cooled by the cooling heatsink 77 to thereby cool and solidify the color toner image and the image-receiving layer, and the electrophotographic image-receiving sheet is then peeled off from the endless belt 73 due to its own rigidity by action of the releasing roller 74.

A remained toner and other unnecessary substances on the surface of the endless belt 73 after the completion of the releasing process are removed by a cleaner (not shown) for another image-fixing process.

<Image Forming Apparatus>

Figure 6:
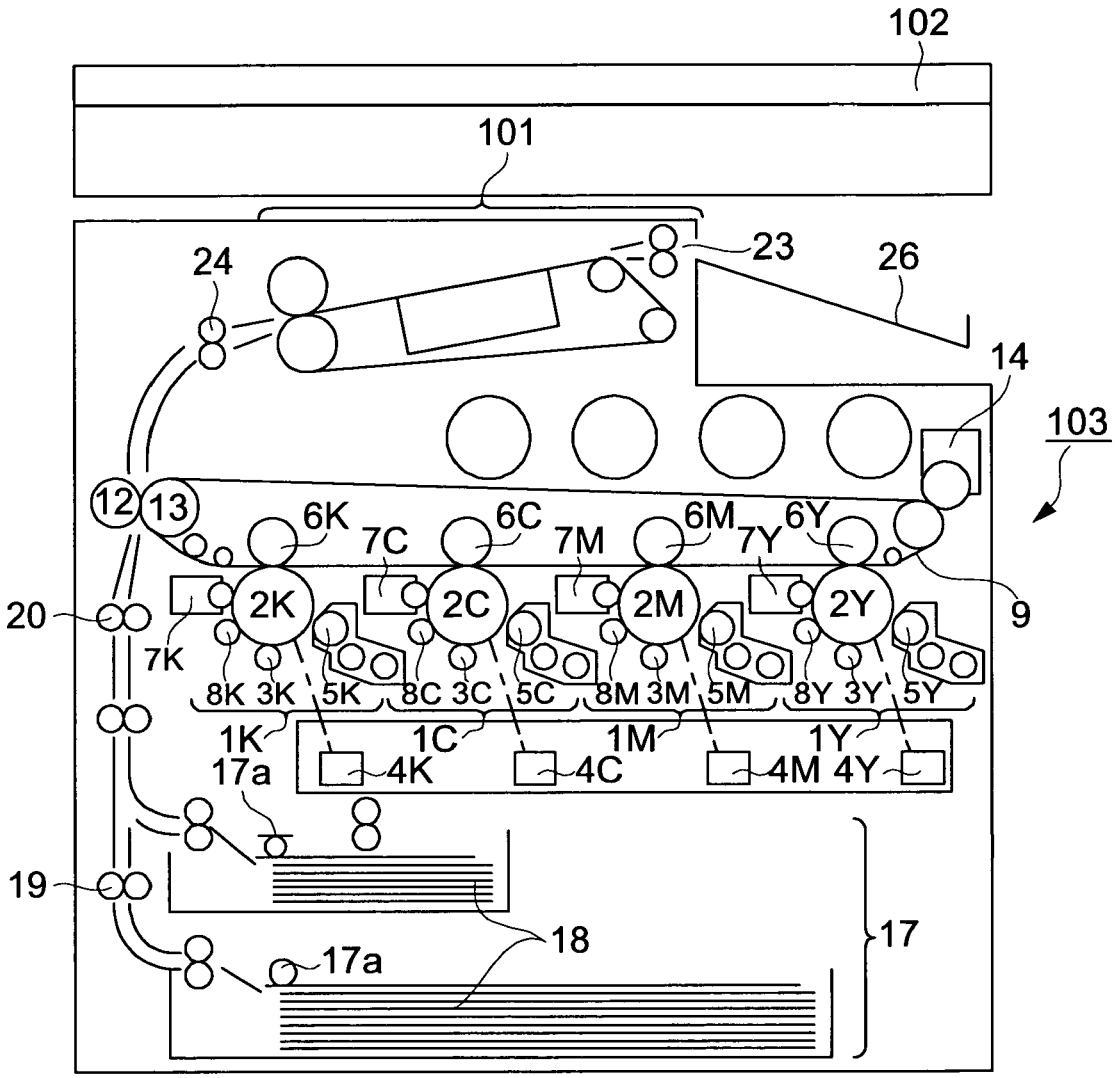
FIG. 6 is a schematic diagram showing an example of an electrophotographic apparatus for use in the present invention.

FIG. 6 is a schematic diagram of a color copying machine (image forming apparatus) constituting the electrophotographic printing system of the present embodiment. The copying machine 100 comprises a main body 103 and an image reader (document read means) 102. The main body 103 houses an image output section (image-forming section) and an image-fixing device 101.

The image forming section comprises an endless intermediate image transfer belt 9 which is spanned over plural tension rollers and is rotated, electrophotographic image forming units 1Y, 1M, 1C, and 1K, a belt cleaner 14 facing the intermediate image transfer belt 9, a secondary image transfer roller 12 facing the intermediate image transfer belt 9, sheet tray 17 for housing sheets of plain paper (image-receiving sheet) 18(S) and sheets of dedicated glossy paper (image-receiving sheet) 18(P), respectively, a pickup roller 17*a*, a pair of conveyer rollers 19 and 24, a pair of resist rollers 20, and a second paper output tray 26. The electrophotographic image forming units 1Y, 1M, 1C, and 1K are arranged from upstream to downstream of a rotation direction of the intermediate image transfer belt 9 and serve to form yellow, magenta, cyan, and black color toner images, respectively.

Each of the electrophotographic image forming units 1Y, 1M, 1C, and 1K comprises, for example, a photoconductive drum 2, an electrostatic charger roller 3, a development device 5, a primary image transfer roller 6, a drum cleaner 7, and a charge eliminating roller 8.

The image-fixing device 101 is arranged below the image reader 102 and above the image forming section (e.g., at image transfer position). The image-fixing device 101 is positioned directly above the image forming section (e.g., the intermediate image transfer belt 9) and directly under the image reader 102. The entire conveying path for the image-receiving sheet 18 extending from the second image transfer position to the image-fixing device 101 is positioned directly above the image forming section (e.g., the intermediate image transfer belt 9). A primary image-fixing line connecting between the secondary image transfer position and the primary image transfer position has a substantially normal vertical component. An image-fixing line connecting between the secondary image transfer position and the image-fixing position has a vertical component less than a horizontal component thereof. The image-receiving sheet 18 is ejected from the image-fixing device 101 to an area directly above the image forming section (e.g., the intermediate image transfer belt 9).

The configuration as above can yield the following advantages. Firstly, the entire apparatus 100 occupies as little space (in particular, as little footprint) as possible even though it comprises the image-fixing device 101. Secondly, the image-receiving sheet 18 is ejected at a relatively high position, and the apparatus can be operated easily.

<Electrophotographic Print>

The electrophotographic print of the present invention is produced by the image forming process of the present invention. It has a 20-degree minimum glossiness of preferably 80 or more.

The 20-degree minimum glossiness is more preferably 85 or more.

The electrophotographic print has texture equivalent to that of silver halide photographs and satisfies the requirement in the amount of curling.

The present invention will be illustrated in further detail with reference to several examples and comparative examples below, which are not intended to limit the scope of the present invention.

EXAMPLES 1 to 13, COMPARATIVE EXAMPLES 1 to 12

Preparation of Support

A series of double-sided polyethylene laminated paper was prepared by applying a first (front side) resin layer and a second (backside) resin layer each having a composition (by mass) and a thickness shown in Table 1 to raw paper having a basis weight shown in Table 1 by extrusion coating. The series of double-sided polyethylene laminated paper was used as supports.

Formation of Back Layer

The following composition for a back layer was applied to the back side of each of the supports to the following dried amounts and was dried and thereby yielded a back layer on the support.

<Composition for Back Layer>

| | |
|---|---|
| SNOW TEX (Nissan Chemical Industries, Ltd.) | 0.022 g/m$^2$ |
| Limed gelatin | 0.039 g/m$^2$ |

Formation of Toner-image-receiving Layer

<Preparation of Composition for a Toner-Image-Receiving Layer>

A composition for a toner-image-receiving layer was prepared by mixing 100 parts by mass of a water-dispersed polyester resin, 5 parts by mass of a releasing agent, 7.5 parts by mass of an aqueous dispersion of a white pigment, 8 parts by mass of a surfactant and an appropriate amount of ion-exchanged water. The water-dispersed polyester resin was Elitel KZA-1449 (trade name, available from Unitika Ltd., Japan) having a solid content of 30% by mass and a flow starting temperature of 100.4° C. The releasing agent was carnauba wax Selosol 524 (trade name, available from Chukyo Yushi Co., Ltd., Japan). The water dispersion of a white pigment was a water dispersion comprising $TiO_2$ TIPAQUE R780-2 (trade name, available from Ishihara Sangyo Kaisha, Ltd., Japan) as the white pigment and a polymer dispersing agent. The surfactant was Nissan Rapisol D-337 (trade name, available from NOF Corporation, Japan) having a solid content of 10% by mass.

The above-prepared composition was applied to a dried thickness of 10 $\mu$m onto the front side of the support by wire coating and was dried. Thus, electrophotographic image-receiving sheets according to Examples 1 to 13 and Comparative Examples 1 to 12 were prepared.

A toner image was formed and smoothed on each of the above-prepared electrophotographic image-receiving sheets, and the sheet was removed from a belt to thereby form electrophotographic prints under the following conditions using an apparatus prepared by modifying the image-fixing unit of the full color laser printer DCC-500 (trade name, available from Fuji Xerox Co., Ltd., Japan) shown in FIG. 4 to the belt image-fixing unit shown in FIG. 5.

Belt

Support: a polyimide (PI) film 50 cm wide

Releasing layer material: SIFEL (trade name, available from Shin-Etsu Chemical Co., Ltd., Japan, a fluorocarbon-siloxane rubber precursor) 50 $\mu$m thick Hot-Pressing Roll Temperature: 140° C.

Cooling Process

Cooling device: a heatsink 80 mm long

Speed: 53 mm/sec

Transit time: 1.5 sec

Print Image

The following three print images shown in Table 2 were used.

(1) Photographed image

A portrait image photographed with a digital still camera (toner amount: about 5 g/m$^2$)

(2) Black image

An entire solid black image (possible maximum amount of the toner, toner amount: about 12 g/m$^2$)

(3) White image

An entire solid white image (entire white background) (toner amount: 0 g/m$^2$)

Size of Electrophotographic Image-receiving Sheets

L size: 89 mm wide, 127 mm long

A6 size: 105 mm wide, 150 mm long

A4 size: 210 mm wide, 300 mm long

Exit Angle of Belt Fixing and Smoothing Apparatus

The exit angle in the belt fixing and smoothing apparatus was set in a range from 0° to 10° as shown in Table 1.

TABLE 1

| | Basis weight of raw paper (g/m$^2$) | Front side* resin layer Composition HDPE:LDPE | Front side* resin layer Thickness ($\mu$m) | Backside resin layer Composition HDPE:LDPE | Backside resin layer Thickness ($\mu$m) | Exit angle (degree) |
|---|---|---|---|---|---|---|
| Ex. 1 | 150 | 0:1.0 | 30 | 0.7:0.3 | 20 | 2 |
| Ex. 2 | 150 | 0:1.0 | 30 | 0.7:0.3 | 20 | 2 |
| Ex. 3 | 150 | 0:1.0 | 30 | 0.7:0.3 | 20 | 2 |
| Ex. 4 | 150 | 0:1.0 | 30 | 0.7:0.3 | 20 | 2 |
| Ex. 5 | 150 | 0:1.0 | 30 | 0.7:0.3 | 20 | 2 |
| Ex. 6 | 150 | 0:1.0 | 30 | 0.7:0.3 | 20 | 2 |
| Ex. 7 | 150 | 0:1.0 | 30 | 0.7:0.3 | 20 | 2 |
| Ex. 8 | 150 | 0:1.0 | 30 | 0.7:0.3 | 20 | 2 |
| Ex. 9 | 150 | 0:1.0 | 30 | 0.7:0.3 | 20 | 2 |
| Ex. 10 | 170 | 0.5:0.5 | 30 | 0.7:0.3 | 30 | 8 |
| Ex. 11 | 130 | 0:1.0 | 20 | 0.7:0.3 | 40 | 6 |

TABLE 1-continued

| | Basis weight of raw paper (g/m²) | Front side* resin layer Composition HDPE:LDPE | Front side* resin layer Thickness (μm) | Backside resin layer Composition HDPE:LDPE | Backside resin layer Thickness (μm) | Exit angle (degree) |
|---|---|---|---|---|---|---|
| Ex. 12 | 150 | 0:1.0 | 20 | 0.7:0.3 | 30 | 4 |
| Ex. 13 | 150 | 0.5:0.5 | 30 | 0.7:0.3 | 20 | 0 |
| Com. Ex. 1 | 120 | 0.7:0.3 | 30 | 0:1.0 | 20 | 0 |
| Com. Ex. 2 | 120 | 0.7:0.3 | 30 | 0:1.0 | 20 | 0 |
| Com. Ex. 3 | 120 | 0.7:0.3 | 30 | 0:1.0 | 20 | 0 |
| Com. Ex. 4 | 120 | 0.7:0.3 | 30 | 0:1.0 | 20 | 0 |
| Com. Ex. 5 | 120 | 0.7:0.3 | 30 | 0:1.0 | 20 | 0 |
| Com. Ex. 6 | 120 | 0.7:0.3 | 30 | 0:1.0 | 20 | 0 |
| Com. Ex. 7 | 120 | 0.7:0.3 | 30 | 0:1.0 | 20 | 0 |
| Com. Ex. 8 | 120 | 0.7:0.3 | 30 | 0:1.0 | 20 | 0 |
| Com. Ex. 9 | 120 | 0.7:0.3 | 30 | 0:1.0 | 20 | 0 |
| Com. Ex. 10 | 150 | 0.7:0.3 | 30 | 0:1.0 | 20 | 0 |
| Com. Ex. 11 | 100 | 0:1.0 | 20 | 0.7:0.3 | 50 | 10 |
| Com. Ex. 12 | 170 | none | — | none | — | 0 |

*Front side: The side on which a toner-image-receiving layer is arranged.

The amount of curling, glossiness, sensory image quality, and sensory quality on curling of the above-prepared electrophotographic prints according to Examples 1 to 13 and Comparative Examples 1 to 12 were evaluated by the following methods. The results are shown in Table 2.

<Curling Amount>

A tested electrophotographic print was placed on a level surface of a stage so that a curled convex surface of the electrophotographic print pointed downward. The heights at four corners (four points) of the print were determined, and the amount of curling C (mm) was defined as the average of the measured four heights. When the curled convex surface is an image-bearing surface, the amount of curling C is defined as positive, and when the curled convex is the back side of the electrophotographic print, the amount of curling C is defined as negative.

<Glossiness>

The glossiness was determined with a portable three-degrees glossimeter Micro-TRI-Gloss (trade name, available from BYK-Gardner USA) at a measuring angle of 20 degrees. The glossiness was determined on the black or white solid image alone.

In the following sensory tests, the quality was rated according to the following criteria and was expressed as an average of 20 persons' ratings, who are capable of rating image quality of photographs relatively excellently.

<Sensory Image Quality>

5: The image quality of the print is equivalent to silver halide photographs.

4: The image quality of the print is near to silver halide photographs and is acceptable as a photograph.

3: The image quality of the print is different from silver halide photographs but is acceptable as a photograph to some extent.

2: The image quality of the print is clearly inferior to silver halide photographs and is not acceptable as a photograph.

1: The image quality of the print is not acceptable.

<Sensory Quality on Curling>

5: The sensory quality on curing of the print is very good and equivalent to or higher than silver halide photographs.

4: The sensory quality on curing of the print is equivalent to silver halide photographs and the print gives a natural feeling as a photograph.

3: The sensory quality on curing of the print is different from silver halide photographs but is acceptable as a photograph to some extent.

2: The sensory quality on curing of the print is significantly inferior to silver halide photographs and is not acceptable as a photograph.

1: The sensory quality on curing of the print is not acceptable at all as a print.

TABLE 2

| | Print image Type | Print image Average toner amount (g/m²) | Sheet size Size | Sheet size Short side length L (mm) | Curling amount C (mm) | Glossiness | Sensory image quality | Sensory quality on curling |
|---|---|---|---|---|---|---|---|---|
| Ex. 1 | photographed image | about 5 | L | 89 | 0 | — | 3.7 | 4.8 |
| Ex. 2 | black image | about 12 | L | 89 | 0 | 88 | — | — |
| Ex. 3 | white image | 0 | L | 89 | 0 | 84 | — | — |
| Ex. 4 | photographed image | about 5 | A6 | 105 | 0 | — | 3.7 | 4.8 |
| Ex. 5 | black image | about 12 | A6 | 105 | 0 | 88 | — | — |
| Ex. 6 | white image | 0 | A6 | 105 | 0 | 84 | — | — |
| Ex. 7 | photographed image | about 5 | A4 | 210 | 0 | — | 3.8 | 4.6 |
| Ex. 8 | black image | about 12 | A4 | 210 | +0.005L | 88 | — | — |
| Ex. 9 | white image | 0 | A4 | 210 | −0.005L | 84 | — | — |
| Ex. 10 | photographed image | about 5 | L | 89 | +0.011L | — | 3.6 | 3.8 |

TABLE 2-continued

| | Print image | | Sheet size | | | | | |
|---|---|---|---|---|---|---|---|---|
| | Type | Average toner amount ($g/m^2$) | Size | Short side length L (mm) | Curling amount C (mm) | Glossiness | Sensory image quality | Sensory quality on curling |
| Ex. 11 | photographed image | about 5 | L | 89 | −0.090L | — | 3.6 | 3.0 |
| Ex. 12 | photographed image | about 5 | L | 89 | −0.044L | — | 3.7 | 4.0 |
| Ex. 13 | photographed image | about 5 | L | 89 | +0.039L | — | 3.5 | 3.0 |
| Com. Ex. 1 | photographed image | about 5 | L | 89 | +0.090L | — | 3.5 | 1.3 |
| Com. Ex. 2 | black image | about 12 | L | 89 | +0.112L | 88 | — | — |
| Com. Ex. 3 | white image | 0 | L | 89 | +0.056L | 85 | — | — |
| Com. Ex. 4 | photographed image | about 5 | A6 | 105 | +0.086L | — | 3.5 | 1.3 |
| Com. Ex. 5 | black image | about 12 | A6 | 105 | +0.114L | 88 | — | — |
| Com. Ex. 6 | white image | 0 | A6 | 105 | +0.057L | 85 | — | — |
| Com. Ex. 7 | photographed image | about 5 | A4 | 210 | +0.076L | — | 3.6 | 1.4 |
| Com. Ex. 8 | black image | about 12 | A4 | 210 | +0.105L | 88 | — | — |
| Com. Ex. 9 | white image | 0 | A4 | 210 | +0.052L | 85 | — | — |
| Com. Ex. 10 | photographed image | about 5 | L | 89 | +0.056L | — | 3.7 | 2.0 |
| Com. Ex. 11 | photographed image | about 5 | L | 89 | −0.112L | — | 3.5 | 2.5 |
| Com. Ex. 12 | photographed image | about 5 | L | 89 | +0.180L | — | 2.5 | 1.0 |

The present invention solves various problems in conventional technologies and produces a high-quality electrophotographic print having high gloss, less unevenness in image and high image quality close to silver halide photographic image quality, exhibiting texture equivalent to that of silver halide photographs and exhibiting less curling.

What is claimed is:

1. An image fixing and smoothing process comprising the steps of:

with a belt fixing and smoothing apparatus, fixing a toner image formed on an image bearing surface of an electrophotographic image-receiving sheet, smoothing the toner image, and releasing the electrophotographic image-receiving sheet bearing the toner image to thereby produce an electrophotographic print, wherein the belt fixing and smoothing apparatus comprises:

a hot-pressing member comprising a heating roller and a pressure roller, a belt member, a cooling device, and a cooling-releasing section, wherein the heating roller and the pressure roller are disposed to thereby form a nip therebetween and are configured to control the amount of curling C (mm) of the electrophotographic print such that it satisfies the following condition:

$$-0.10\,L \leqq C \leqq +0.05\,L$$

wherein L is a length (mm) of a short side of the electrophotographic print; a negative value (−) of the amount of curling C means that the electrophotographic print curls so that its surface opposite to the image-bearing surface is inside; and a positive value (+) of the amount of curling C means that the electrophotographic print curls so that its image-bearing surface is inside.

2. An image fixing and smoothing process according to claim 1, wherein the steps of fixing and smoothing the toner image on the image-bearing surface of the electrophotographic image-receiving sheet are performed one of simultaneously and sequentially in this order.

3. An image fixing and smoothing process according to claim 1, wherein the amount of curling C (mm) is determined after leaving the produced electrophotographic print in an atmosphere that a temperature is 25° C. and a relative humidity is 50%, for 10 minutes.

4. An image fixing and smoothing process according to claim 1, wherein the amount of curling C (mm) determined after leaving the produced electrophotographic print in an atmosphere that the temperature is 25° C. and a relative humidity is 50%, for 10 minutes or longer, satisfies the following condition:

$$-0.10\,L \leqq C \leqq +0.05\,L$$

wherein L, the negative value (−) and the positive value (+) of the amount of curling C have the same meanings as defined in claim 1.

5. An image fixing and smoothing process according to claim 1, wherein the amount of curling C (mm) satisfies the following condition:

$$-0.05\,L \leqq C \leqq +0.02\,L$$

wherein L, the negative value (−) and the positive value (+) of the amount of curling C have the same meanings as defined in claim 1.

6. An image fixing and smoothing process according to claim 1, wherein a toner is applied to the image-bearing surface of the electrophotographic image-receiving sheet in an amount of 0 to 12 $g/m^2$.

7. An image fixing and smoothing process according to claim 1, wherein the electrophotographic image-receiving sheet comprises:

a support; and at least one toner-image-receiving layer arranged over the support, wherein the support comprises, raw paper, a first polyolefin resin layer arranged between the toner-image-receiving layer and the support, and a second polyolefin resin layer arranged on an opposite side of the support to the first polyolefin resin layer.

8. An image fixing and smoothing process according to claim 7, wherein the first polyolefin resin layer has crystallinity lower than that of the second polyolefin resin layer.

9. An image fixing and smoothing process according to claim 8, wherein the first polyolefin resin layer comprises a low-density polyethylene, and wherein the second polyolefin resin layer comprises one of a high-density polyethylene and a mixture of a high-density polyethylene and a low-density polyethylene.

10. An image fixing and smoothing process according to claim 7, wherein the raw paper has a basis weight of 130 g/m$^2$ or more.

11. An image fixing and smoothing process according to claim 7, wherein the raw paper has a thickness of 30 $\mu$m to 500 $\mu$m.

12. An image fixing and smoothing process according to claim 1, wherein the angle (exit angle) θ between the tangent line in the nip between the heating roller and the pressure roller and the direction of travel of the belt member after passing through the nip satisfies the following condition:

$$-2^\circ < \theta \leqq 10^\circ.$$

13. An image fig and smoothing process according to claim 1, wherein the belt member has a support film and a releasing layer arranged on the support film.

14. An image fixing and smoothing process according to claim 13, wherein the releasing layer has a thickness of 1 $\mu$m to 200 $\mu$m.

15. An image fixing and smoothing process according to claim 13, wherein the releasing layer comprises one of a fluorocarbonsiloxane rubber layer alone and a combination of a silicone rubber layer and a fluorocarbonsiloxane rubber layer arranged on the silicone rubber layer.

16. An image fixing and smoothing process according to claim 15, wherein the fluorocarbonsiloxane rubber has at least one of perfluoroalkyl ether groups and perfluoroalkyl groups in its principal chain.

17. A belt fixing and smoothing apparatus comprising:

a hot-pressing member comprising a heat roller and a pressure roller in which the heat roller and the pressure roller are disposed to thereby form a nip therebetween, a belt member, a cooling device, and a cooling-releasing section, wherein the belt fixing and smoothing apparatus fixes a toner image formed on an image bearing surface of an electrophotographic image-receiving sheet, smoothes the toner image fixed, and releases the electrophotographic image-receiving sheet bearing the toner image to thereby produce an electrophotographic print, and wherein the heat roller and the pressure roller in the hot-pressing member are configured to control the amount of curling C (mm) of the electrophotographic print such that it satisfies the following condition:

$$-0.10\,L \leqq C \leqq +0.05\,L$$

wherein L is a length (mm) of a short side of the electrophotographic print; a negative value (−) of the amount of curling C means that the electrophotographic print curls so that its surface opposite to the image-bearing surface is inside; and a positive value (+) of the amount of curling C means that the electrophotographic print curls so that its image-bearing surface is inside.

18. A belt fixing and smoothing apparatus according to claim 17, wherein the angle (exit angle) θ between the tangent line in a nip between the heating roller and the pressure roller and the direction of travel of the belt member after passing through the nip satisfies the following condition:

$$-2 < \theta \leqq 10^\circ.$$

19. An electrophotographic print obtained by the image fixing and smoothing process according to claim 1, having:

an amount of curling C (mm) of the electrophotographic print satisfying the following condition:

$$-0.10\,L \leqq C \leqq +0.05\,L$$

wherein L is a length (mm) of a short side of the electrophotographic print; a negative value (−) of the amount of curling C means that the electrophotographic print curls so that its surface opposite to the image-bearing surface is inside; and a positive value (+) of the amount of curling C means that the electrophotographic print curls so that its image-bearing surface is inside.

20. An electrophotographic print according to claim 19, wherein the amount of curling C (mm) satisfies the following condition:

$$-0.05 \leqq C \leqq +0.02\,L$$

wherein L, the negative value (−) and the positive value (+) of the amount of curling C have the same meanings as defined above.

21. An electrophotographic print according to claim 19, wherein the electrophotographic print has a 20-degree glossiness of 80 or more.

* * * * *